US008676104B2

(12) United States Patent
Yoshikawa et al.

(10) Patent No.: US 8,676,104 B2
(45) Date of Patent: Mar. 18, 2014

(54) FIXING DEVICE AND IMAGE FORMING APPARATUS

(75) Inventors: Masaaki Yoshikawa, Tokyo (JP); Tetsuo Tokuda, Kanagawa (JP); Yutaka Ikebuchi, Kanagawa (JP); Takuya Seshita, Kanagawa (JP); Hiroshi Yoshinaga, Chiba (JP); Hajime Gotoh, Kanagawa (JP); Yoshiki Yamaguchi, Kanagawa (JP); Toshihiko Shimokawa, Kanagawa (JP); Kenji Ishii, Kanagawa (JP); Takahiro Imada, Kanagawa (JP); Naoki Iwaya, Tokyo (JP); Yuji Arai, Kanagawa (JP); Arinobu Yoshiura, Kanagawa (JP); Hiromasa Takagi, Tokyo (JP); Ippei Fujimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 58 days.

(21) Appl. No.: 13/315,581

(22) Filed: Dec. 9, 2011

(65) Prior Publication Data

US 2012/0155935 A1 Jun. 21, 2012

(30) Foreign Application Priority Data

Dec. 17, 2010 (JP) ..... 2010-282123
Dec. 20, 2010 (JP) ..... 2010-282692

(51) Int. Cl.
*G03G 15/20* (2006.01)

(52) U.S. Cl.
USPC ..... 399/329

(58) Field of Classification Search
USPC ..... 399/329
See application file for complete search history.

(56) References Cited

U.S. PATENT DOCUMENTS

| | | | |
|---|---|---|---|
| 6,628,916 | B2 | 9/2003 | Yasui et al. |
| 6,636,709 | B2 | 10/2003 | Furukawa et al. |
| 6,778,790 | B2 | 8/2004 | Yoshinaga et al. |
| 6,778,804 | B2 | 8/2004 | Yoshinaga et al. |

(Continued)

FOREIGN PATENT DOCUMENTS

| | | |
|---|---|---|
| JP | 4-44075 | 2/1992 |
| JP | 8-262903 | 10/1996 |

(Continued)

OTHER PUBLICATIONS

Machine translation of JP 2010026415 A.*

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

A fixing device, including a fixing member; a pressure member; a nip forming member; a reinforcing member; a heating member; and a flange member including a cylinder inserted in an inner circumference at an edge of the fixing member in an axial direction thereof and a flange fixed on a frame of the fixing device, wherein the cylinder of the flange member includes a notch storing the nip forming member at a part on the circumference, has an arc-shaped outer circumferential cross-section at an area corresponding to an area where the fixing member is heated by the heating member, having a predetermined radius equivalent to a radius of the fixing member, and the arc has a center located at an upstream side in a recording medium feeding direction relative to a center line of the nip forming member in the recording medium feeding direction.

6 Claims, 13 Drawing Sheets

(56) References Cited

U.S. PATENT DOCUMENTS

| | | | |
|---|---|---|---|
| 6,785,505 | B2 | 8/2004 | Yasui et al. |
| 6,813,464 | B2 | 11/2004 | Amita et al. |
| 6,881,927 | B2 | 4/2005 | Yoshinaga et al. |
| 6,882,820 | B2 | 4/2005 | Shinshi et al. |
| 6,892,044 | B2 | 5/2005 | Yasui et al. |
| 6,937,827 | B2 | 8/2005 | Katoh et al. |
| 7,022,944 | B2 | 4/2006 | Yoshinaga et al. |
| 7,054,570 | B2 | 5/2006 | Kishi et al. |
| 7,116,923 | B2 | 10/2006 | Kishi et al. |
| 7,127,204 | B2 | 10/2006 | Satoh et al. |
| 7,130,555 | B2 | 10/2006 | Kishi et al. |
| 7,151,907 | B2 | 12/2006 | Yoshinaga |
| 7,209,675 | B2 | 4/2007 | Matsusaka et al. |
| 7,212,758 | B2 | 5/2007 | Kishi et al. |
| 7,212,759 | B2 | 5/2007 | Kishi et a |
| 7,239,821 | B2 | 7/2007 | Matsusaka et al. |
| 7,239,838 | B2 | 7/2007 | Sato et al. |
| 7,242,897 | B2 | 7/2007 | Satoh et al. |
| 7,308,216 | B2 | 12/2007 | Kishi et al. |
| 7,313,353 | B2 | 12/2007 | Satoh et al. |
| 7,333,743 | B2 | 2/2008 | Kishi et al. |
| 7,343,113 | B2 | 3/2008 | Matsusaka et al. |
| 7,352,987 | B2 | 4/2008 | Iwata et al. |
| 7,356,270 | B2 | 4/2008 | Matsusaka et al. |
| 7,366,432 | B2 | 4/2008 | Kishi et al. |
| 7,373,094 | B2 | 5/2008 | Kishi et al. |
| 7,379,698 | B2 | 5/2008 | Yoshinaga |
| 7,437,111 | B2 | 10/2008 | Yamada et al. |
| 7,454,151 | B2 | 11/2008 | Satoh et al. |
| 7,466,949 | B2 | 12/2008 | Satoh et al. |
| 7,486,916 | B2 | 2/2009 | Tsuda et al. |
| 7,496,309 | B2 | 2/2009 | Matsusaka et al. |
| 7,509,085 | B2 | 3/2009 | Yoshinaga et al. |
| 7,515,845 | B2 | 4/2009 | Kishi et al. |
| 7,546,049 | B2 | 6/2009 | Ehara et al. |
| 7,551,869 | B2 | 6/2009 | Kishi et al. |
| 7,565,087 | B2 | 7/2009 | Matsusaka et al. |
| 7,570,910 | B2 | 8/2009 | Ishii |
| 7,603,049 | B2 | 10/2009 | Kishi et al. |
| 7,609,988 | B2 | 10/2009 | Kishi et al. |
| 7,664,410 | B2 | 2/2010 | Takagi |
| 7,702,271 | B2 | 4/2010 | Yamada et al. |
| 7,783,240 | B2 | 8/2010 | Ito et al. |
| 7,796,933 | B2 | 9/2010 | Ueno et al. |
| 7,801,457 | B2 | 9/2010 | Seo et al. |
| 7,824,834 | B2 | 11/2010 | Awamura et al. |
| 7,840,151 | B2 | 11/2010 | Fujimoto |
| 7,885,569 | B2 | 2/2011 | Kishi et al. |
| 7,912,392 | B2 | 3/2011 | Yoshinaga et al. |
| 7,925,177 | B2 | 4/2011 | Ishii et al. |
| 7,953,338 | B2 | 5/2011 | Takagi |
| 7,957,663 | B2 | 6/2011 | Kishi et al. |
| 7,983,598 | B2 | 7/2011 | Shinshi et al. |
| 8,023,861 | B2 | 9/2011 | Yoshinaga et al. |
| 2005/0123315 | A1 | 6/2005 | Kishi et al. |
| 2006/0051111 | A1 | 3/2006 | Kishi et al. |
| 2006/0257183 | A1 | 11/2006 | Ehara et al. |
| 2007/0014600 | A1 | 1/2007 | Ishii et al. |
| 2007/0031159 | A1 | 2/2007 | Kishi et al. |
| 2008/0063443 | A1 | 3/2008 | Yoshinaga et al. |
| 2008/0317532 | A1 | 12/2008 | Ehara et al. |
| 2009/0067902 | A1 | 3/2009 | Yoshinaga et al. |
| 2009/0123201 | A1 | 5/2009 | Ehara et al. |
| 2009/0123202 | A1 | 5/2009 | Yoshinaga et al. |
| 2009/0169232 | A1 | 7/2009 | Kunii et al. |
| 2010/0074667 | A1 | 3/2010 | Ehara et al. |
| 2010/0092220 | A1 | 4/2010 | Hasegawa et al. |
| 2010/0092221 | A1 | 4/2010 | Shinshi et al. |
| 2010/0202809 | A1 | 8/2010 | Shinshi et al. |
| 2010/0290822 | A1 | 11/2010 | Hasegawa et al. |
| 2010/0303521 | A1 | 12/2010 | Ogawa et al. |
| 2011/0026988 | A1 | 2/2011 | Yoshikawa et al. |
| 2011/0044706 | A1 | 2/2011 | Iwaya et al. |
| 2011/0044734 | A1 | 2/2011 | Shimokawa et al. |
| 2011/0052237 | A1 | 3/2011 | Yoshikawa et al. |
| 2011/0052245 | A1 | 3/2011 | Shinshi et al. |
| 2011/0052277 | A1 | 3/2011 | Ueno et al. |
| 2011/0052282 | A1 | 3/2011 | Shinshi et al. |
| 2011/0058862 | A1 | 3/2011 | Yamaguchi et al. |
| 2011/0058863 | A1 | 3/2011 | Shinshi et al. |
| 2011/0058864 | A1 | 3/2011 | Fujimoto et al. |
| 2011/0058865 | A1 | 3/2011 | Tokuda et al. |
| 2011/0058866 | A1 | 3/2011 | Ishii et al. |
| 2011/0064437 | A1 | 3/2011 | Yamashina et al. |
| 2011/0064443 | A1 | 3/2011 | Iwaya et al. |
| 2011/0064450 | A1 | 3/2011 | Ishii et al. |
| 2011/0064451 | A1 | 3/2011 | Yamaguchi et al. |
| 2011/0064490 | A1 | 3/2011 | Imada et al. |
| 2011/0064502 | A1 | 3/2011 | Hase et al. |
| 2011/0076071 | A1 | 3/2011 | Yamaguchi et al. |
| 2011/0085832 | A1 | 4/2011 | Hasegawa et al. |
| 2011/0116848 | A1 | 5/2011 | Yamaguchi et al. |
| 2011/0129268 | A1 | 6/2011 | Ishii et al. |
| 2011/0150518 | A1 | 6/2011 | Hase et al. |
| 2011/0170917 | A1 | 7/2011 | Yoshikawa et al. |
| 2011/0176822 | A1 | 7/2011 | Ishii et al. |
| 2011/0182634 | A1 | 7/2011 | Ishigaya et al. |
| 2011/0182638 | A1 | 7/2011 | Ishii et al. |
| 2011/0194869 | A1 | 8/2011 | Yoshinaga et al. |
| 2011/0194870 | A1 | 8/2011 | Hase et al. |
| 2011/0200368 | A1 | 8/2011 | Yamaguchi et al. |
| 2011/0200370 | A1 | 8/2011 | Ikebuchi et al. |
| 2011/0206427 | A1 | 8/2011 | Iwaya et al. |
| 2011/0211876 | A1 | 9/2011 | Iwaya et al. |
| 2011/0217056 | A1 | 9/2011 | Yoshinaga et al. |
| 2011/0217057 | A1 | 9/2011 | Yoshinaga et al. |
| 2011/0217093 | A1 | 9/2011 | Tokuda et al. |
| 2011/0217095 | A1 | 9/2011 | Ishii et al. |
| 2011/0222875 | A1 | 9/2011 | Imada et al. |
| 2011/0222888 | A1 | 9/2011 | Ikebuchi et al. |
| 2011/0222926 | A1 | 9/2011 | Ueno et al. |
| 2011/0222929 | A1 | 9/2011 | Fujimoto et al. |
| 2011/0222930 | A1 | 9/2011 | Fujimoto et al. |
| 2011/0222931 | A1 | 9/2011 | Shinshi et al. |
| 2011/0229178 | A1 | 9/2011 | Ogawa et al. |
| 2011/0229181 | A1 | 9/2011 | Iwaya et al. |
| 2011/0229200 | A1 | 9/2011 | Yamaguchi et al. |
| 2011/0229225 | A1 | 9/2011 | Ishii et al. |
| 2011/0229226 | A1 | 9/2011 | Tokuda et al. |
| 2011/0229227 | A1 | 9/2011 | Yoshikawa et al. |
| 2011/0229228 | A1 | 9/2011 | Yoshikawa et al. |
| 2011/0274453 | A1 | 11/2011 | Shimokawa et al. |
| 2011/0286758 | A1 | 11/2011 | Yoshinaga |

FOREIGN PATENT DOCUMENTS

| | | | |
|---|---|---|---|
| JP | 10-213984 | | 8/1998 |
| JP | 11-2982 | | 1/1999 |
| JP | 2004-163464 | | 6/2004 |
| JP | 2006-39184 | | 2/2006 |
| JP | 2006-220950 | | 8/2006 |
| JP | 2007-334205 | | 12/2007 |
| JP | 2010026415 | A * | 2/2010 |
| JP | 2010-96782 | | 4/2010 |

* cited by examiner

VIEW FROM FRONT SIDE

VIEW FROM BACK SIDE

VIEW FROM FRONT SIDE

VIEW FROM BACK SIDE

FIXING DEVICE AND IMAGE FORMING APPARATUS

CROSS-REFERENCE TO RELATED APPLICATIONS

This patent application is based on and claims priority pursuant to 35 U.S.C. §119 to Japanese Patent Applications Nos. 2010-282692 and 2010-282123, filed on Dec. 20, 2010 and Dec. 17, 2010, respectively, in the Japanese Patent Office, the entire disclosures of which are hereby incorporated by reference herein.

FIELD OF THE INVENTION

The present invention relates to a fixing device fixing toner onto a recording medium with heat and pressure, and to an image forming apparatus including the fixing device, such as electrophotographic and electrostatic recording facsimile machines, printers, copiers or multifunction devices having several of these capabilities.

BACKGROUND OF THE INVENTION

Conventionally, a variety of electrophotographic image forming apparatuses are designed and known as image forming apparatuses, such as copiers and printers. The image forming process includes forming an electrostatic latent image on the surface of a photoreceptor drum as an image bearer, developing the electrostatic latent image with a developer such as toner to be visualized as toner image, transferring the toner image onto a recording medium (typically paper) with a transfer device, and fixing the toner image on the recording paper with a fixing device using pressure and heat.

In the fixing device, a fixing member and a pressure member formed of opposing rollers, belts or their combinations contact each other to form a nip. A recording paper is tucked in the nip and a toner image is fixed thereon with heat and pressure.

Japanese published unexamined application No. 11-2982 discloses using a fixing belt stretched by plural roller members as a fixing member. A fixing device using the fixing belt includes a fixing belt (an endless belt) 204, plural rollers 202 and 203 stretching the fixing belt 204, a heater 201 included in one of the rollers 202 and 203, a pressure roller (member) 205, etc. (FIG. 21). The heater heats the fixing belt through the roller member. A toner image on a recording medium fed to a nip formed between the fixing belt and the pressure roller is fixed thereon at the nip with heat and pressure (a belt fixing method).

The fixing device may include a fixing member frictionally contacting the inner surface of the rotating fixing member. Japanese published unexamined application No. 4-44075 discloses a fixing device in which a heat-resistant film (fixing film) 213 is sandwiched between a ceramic heater 211 as a heating element and a pressure roller 212 as a pressure member 212 to form a fixing nip N, and a recording medium on which an unfixed toner image is formed is guided to the fixing nip N and transported with the film 213 to give a heat of the ceramic heater 211 and a pressure to the recording medium through the film 213 at the nip N for fixing the unfixed toner image on the recording medium with heat and pressure (FIG. 22). The fixing device using a film heating method can form an on-demand type apparatus using a low heat capacity member for the ceramic heater and the film. Further, the ceramic heater may be energized to be heated to have a predetermined fixing temperature only when an image is formed, and a waiting time from power on to image formable status of the image forming apparatus is short (quick start) and a power consumed for standby is very small (energy saving).

Japanese published unexamined applications Nos. 8-262903 and 10-213984 disclose a fixing device using a pressure belt method, including a rotatable heat fixing roll having an elastically deformable surface; an endless belt (a pressure belt) runnable while contacting the heat fixing roll; a belt nip unrotatably located on the inside of the endless belt, contacting the endless belt to the heat fixing roll with pressure, and passing a recording paper therebetween; and a pressure pad elastically deform the surface of the heat fixing roll. This fixing method uses a belt as the pressure member below and expands a contact area of a paper and the roll to largely improve heat conduction efficiency, which enables it to reduce energy consumption and downsize the fixing device.

However, although the fixing device disclosed in Japanese published unexamined application No. 11-2982 is more suitable for higher speed printing than the apparatus using a fixing roller, it has a limit in shortening a warm-up time (a time needed for apparatus to reach a printable temperature) and a first print time (a time from receiving a printing request to paper discharge through print preparation and print operation).

On the other hand, the fixing device disclosed in Japanese published unexamined application No. 4-44075 having low heat capacity can shorten the warm-up time and the first print time, and can downsize the apparatus at the same time. However, there are problems with the durability and belt temperature stability of the fixing device. Namely, the inner surface of the belt has insufficient abrasion resistance against the ceramic heater as a heat source, and the surface becomes rough after travelling for a long time and its friction resistance increases, resulting in unstable rotation of the belt, the fixing device increases in drive torque and a the recording medium slips, resulting in image displacement, or stress on a drive gear increases, resulting in damage to the gear (problem 1).

The fixing device using a film heating method locally heating the belt only at the nip, and when the rotating belt returns to the nip, the belt has the lowest temperature, resulting in poor fixation (particularly when the belt rotates fast) (problem 2).

Japanese published unexamined application No. 8-262903 discloses a method of using a glass fiber sheet impregnated with PTFE (PTFE-impregnated glass cloth) as a low friction sheet for a surface layer of the pressure pad to improve friction between the inner surface of the belt and a fixed member. However, the fixing device using a pressure belt method disclosed in Japanese published unexamined applications Nos. 8-262903 and 10-213984 has a large heat capacity and slow in heating, resulting in long warm-up time (problem 3).

To solve the problems 1 to 3, Japanese published unexamined application No. 2007-334205 discloses a fixing device including an almost pipe-shaped opposing member (including a metallic heat conductive material, a heating member and a support member) located on the inner surface of an endless belt and a resistance heating element such as ceramic heaters located on the inner surface of the opposing member to heat the opposing member, which enables it to heat the whole fixing belt, shorten the warm-up time and the first print time and eliminate calorie shortage when the belt rotates fast.

However, the fixing device disclosed in Japanese published unexamined application No. 2007-334205 presses a pressure roller as a pressure member toward the fixing belt to form a nip, which is supported by a metallic heat conductive material. Therefore, a nip width and a pressure at the nip are unstable.

Japanese published unexamined application No. 2010-96782 discloses a fixing device including a nip forming member such as contact members and fixing members, and a reinforcing member to hold and stabilize statuses, shapes and positions of a nip between a fixing belt and pressure roller, and a pipe-shaped support member.

The support member preferably has a predetermined cross-sectional shape to perform predetermined functions, i.e., closely contacting the fixing member to heat the fixing member and ensuring separability of a recording medium. However, it is difficult to precisely maintain the external dimensions of the support member because it is made of thin sheet metal. Uneven external dimensions of the support member cause uneven performance. e.g., the fixing member and the support member do not contact each other at the downstream side of the nip and the fixing member behaves unstably, resulting in poor separability of a recording medium.

Further, even the fixing device disclosed in Japanese published unexamined application No. 4-44075 only rotating the fixing film (belt) without using a support member has a problem of unstable form of the fixing film (belt) at the exit of the nip, resulting in poor separability of a recording medium.

For these reasons, a need exists for a fixing device capable of delivering improved separability of a recording medium.

SUMMARY OF THE INVENTION

Accordingly, the present invention provides a fixing device with improved separability of a recording medium, and an image forming apparatus using the fixing device.

These objects and other objects of the present invention, either individually or collectively, have been satisfied by the invention of an improved fixing device, comprising:

a rotatable endless belt fixing member;

a pressure member located at an outer circumferential side of the fixing member, configured to contact the fixing member with pressure;

a nip forming member located at an inner circumferential side of the fixing member, configured to contact the pressure member through the fixing member to form a nip;

a reinforcing member fixed at a bore of the fixing member, configured to support the nip forming member from the opposite side of the nip;

a heating member configured to directly or indirectly heat a predetermined area of the fixing member at an upstream side of the nip; and a flange member comprising a cylinder inserted in an inner circumference at an end of the fixing member in an axial direction thereof and configured to rotatably hold an end vicinity of the fixing member directly or indirectly by the outer circumferential surface, and a flange fixed on a frame of the fixing device, wherein the cylinder of the flange member comprises a notch storing the nip forming member at a part on the circumference, has an arc-shaped outer circumferential cross-section at an area corresponding to an area where the fixing member is heated by the heating member, having a predetermined radius equivalent to a radius of the fixing member, and the arc has a center located at an upstream side in a recording medium feeding direction relative to a center line of the nip forming member in the recording medium feeding direction.

These and other objects, features and advantages of the present invention will become apparent upon consideration of the following description of the preferred embodiments of the present invention taken in conjunction with the accompanying drawings.

DETAILED DESCRIPTION OF THE INVENTION

The present invention provides a fixing device improved in separability of a recording medium.

More particularly, the present invention relates to a fixing device, comprising:

a fixing member, which is a rotatable endless belt;

a pressure member located at an outer circumferential side of the fixing member, configured to contact the fixing member with pressure;

a nip forming member located at an inner circumferential side of the fixing member, configured to contact the pressure member through the fixing member to form a nip;

a reinforcing member fixed at a bore of the fixing member, configured to support the nip forming member from the opposite side of the nip;

a heating member configured to directly or indirectly heat a predetermined area of the fixing member at an upstream side of the nip; and a flange member comprising a cylinder inserted in an inner circumference at an end of the fixing member in an axial direction thereof and configured to rotatably hold an end vicinity of the fixing member directly or indirectly by the outer circumferential surface, and a flange fixed on a frame of the fixing device, wherein the cylinder of the flange member comprises a notch storing the nip forming member at a part on the circumference, has an arc-shaped outer circumferential cross-section at an area corresponding to an area where the fixing member is heated by the heating member, having a predetermined radius equivalent to a radius of the fixing member, and the arc has a center located at an upstream side in a recording medium feeding direction relative to a center line of the nip forming member in the recording medium feeding direction.

Figure 1:
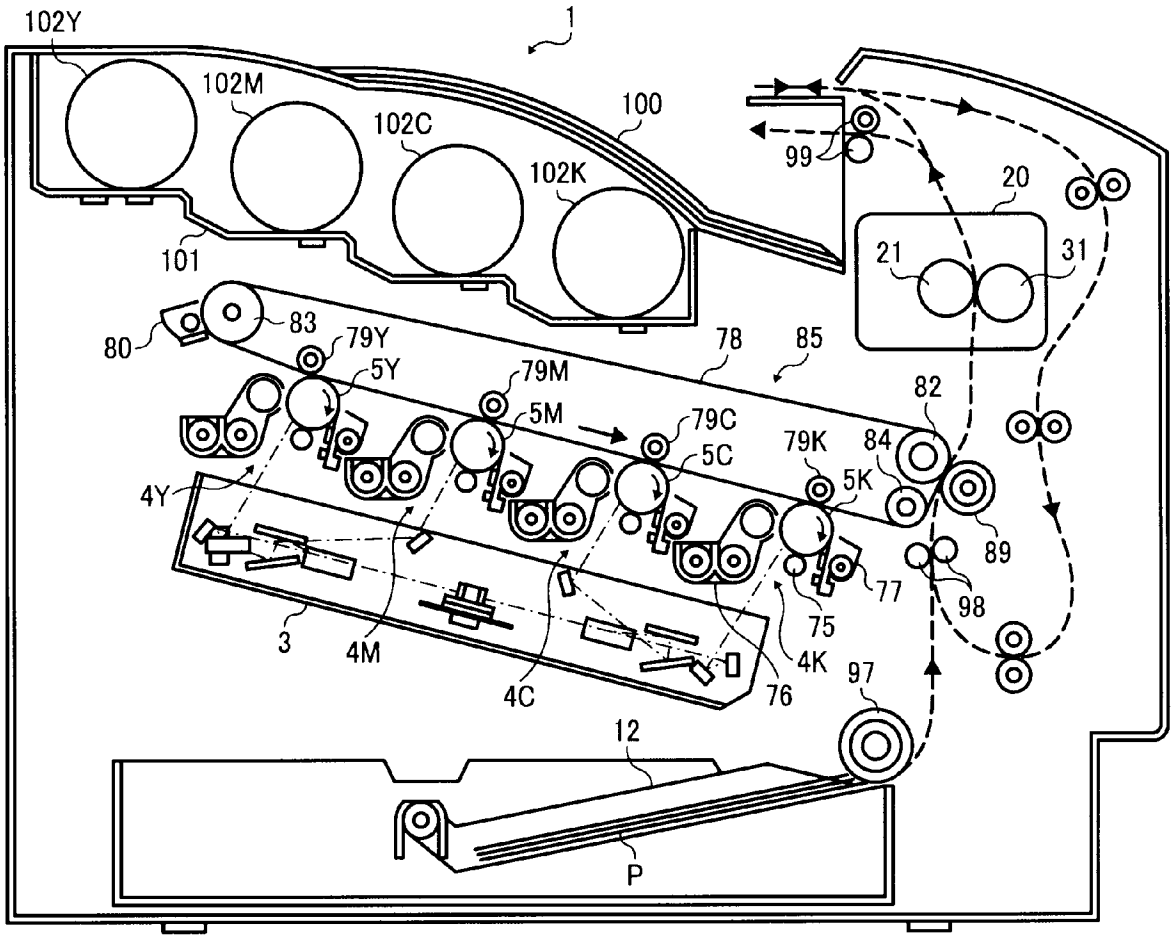
FIG. 1 is a schematic view illustrating an image forming apparatus including the fixing device of the present invention.

FIG. 1 is a schematic view illustrating an image forming apparatus including the fixing device of the present invention.

An image forming apparatus 1 is a tandem color printer. Four toner bottles 102Y, 102M, 102C and 102K for each color (yellow, magenta, cyan and black) are detachably set in a bottle deck 101 located above the image forming apparatus 1. Therefore, the four toner bottles 102Y, 102M, 102C and 102K are exchangeable by a user.

An intermediate transfer unit 85 is located below the bottle deck 101. Image forming units 4Y, 4M, 4C and 4K for each color (yellow, magenta, cyan and black) are located in line facing an intermediate transfer belt 78 of the intermediate transfer unit 85.

The image forming units 4Y, 4M, 4C and 4K include photoreceptor drums 5Y, 5M, 5C and 5K, respectively. Around each of the photoreceptor drums 5Y, 5M, 5C and 5K, a charger 75, an image developer 76, a cleaner 77 and an illustrated discharger are located. On each of the photoreceptor drums 5Y, 5M, 5C and 5K, image forming processes, i.e., a charging process, an irradiation process, a developing process, a transfer process and a cleaning process are made to from each color image on each of the photoreceptor drums 5Y, 5M, 5C and 5K.

Each of the photoreceptor drums 5Y, 5M, 5C and 5K is rotationally driven by an unillustrated drive motor clockwise in FIG. 1. The surface of each of the photoreceptor drums 5Y, 5M, 5C and 5K is uniformly charged at a position of the charger 75 (charging process). Then, the surface of each of the photoreceptor drums 5Y, 5M, 5C and 5K reaches an irradiated position of a laser beam emitted from an irradiator 3, where an electrostatic latent image for each color is formed by irradiation scanning (irradiation process).

Then, the surface of each of the photoreceptor drums 5Y, 5M, 5C and 5K reaches a position facing the image developer 76, where the electrostatic is developed to form each color toner image (developing process). Then, the surface of each of the photoreceptor drums 5Y, 5M, 5C and 5K reaches a position facing the intermediate transfer belt 78 and first transfer bias rollers 79Y, 79M, 79C and 79K, where the toner image on each of the photoreceptor drums 5Y, 5M, 5C and 5K is transferred onto the intermediate transfer belt 78 (first transfer process). At that time, an untransferred toner slightly remains on each of the photoreceptor drums 5Y, 5M, 5C and 5K.

Then, the surface of each of the photoreceptor drums 5Y, 5M, 5C and 5K reaches a position facing the cleaner 77, where the untransferred toner remaining on each of the photoreceptor drums 5Y, 5M, 5C and 5K is mechanically collected by a cleaning blade of the cleaner 77 (cleaning process).

Finally, the surface of each of the photoreceptor drums 5Y, 5M, 5C and 5K reaches a position facing the unillustrated discharger, where a residual potential on each of the photoreceptor drums 5Y, 5M, 5C and 5K is removed. Thus, a series of image forming processes made on each of the photoreceptor drums 5Y, 5M, 5C and 5K is completed.

Each toner image formed on each of the photoreceptor drums is overlappingly transferred onto the intermediate transfer belt 78. Thus, a color image is formed thereon. The intermediate transfer unit 85 includes the intermediate transfer belt 78; the four first transfer bias rollers 79Y, 79M, 79C and 79K; a second transfer backup roller 82; a cleaning backup roller 83; a tension roller 84; an intermediate transfer cleaner 80, etc. The intermediate transfer belt 78 is stretched and supported by the three rollers 82 to 84 and is endlessly transferred by rotary drive of the roller 82 in an arrow direction in FIG. 1.

Each of the four first transfer bias rollers 79Y, 79M, 79C and 79K sandwiches the intermediate transfer belt 78 with each of the photoreceptor drums 5Y, 5M, 5C and 5K to form a first transfer nip. A transfer bias having a polarity reverse to that of toner is applied to each of the first transfer bias rollers 79Y, 79M, 79C and 79K. The intermediate transfer belt 78 travels in an arrow direction and passes through the first transfer nip of each of the first transfer bias rollers 79Y, 79M, 79C and 79K. Thus, each color toner image on each of the photoreceptor drums 5Y, 5M, 5C and 5K is overlapping first transferred onto the intermediate transfer belt 78.

Then, the intermediate transfer belt 78 each color toner image is overlappingly transferred on reaches a position facing a second transfer roller 89, where the second transfer backup roller 82 sandwiches the intermediate transfer belt 78 with the second transfer roller 89 to form a second transfer nip. A four-color toner image formed on the intermediate transfer belt 78 is transferred onto a recording medium P fed to the second transfer nip. Then, toner having not been transferred onto the recording medium P remains on the intermediate transfer belt 78. The intermediate transfer belt 78 reaches a position of the intermediate transfer cleaner 80, where the untransferred toner on the intermediate transfer belt 78 is collected. Thus, a series of transfer processes made on the intermediate transfer belt 78 are completed.

The recording medium P fed to the second transfer nip is from a paper feeder 12 located at the bottom of the apparatus 1 through a paper feed roller 97 and a registration roller 98.

Plural recording media P such as transfer papers are overlappingly stored in the paper feeder 12. When the paper feed roller 97 is rotationally driven anticlockwise in FIG. 1, the uppermost recording medium P is fed between a pair of the registration rollers 98.

The recording medium P fed by the pair of the registration roller 98 stops at a roller nip thereof having stopped rotary drive. The pair of the registration roller 98 is rotationally driven in timing for a color image on the intermediate transfer belt 78 to feed a recording medium P to the second transfer nip. Thus, a desired color image is transferred onto the recording medium P.

The recording medium P the color image is transferred on at the second transfer nip is fed to a fixing device 20, where the color image is fixed by a fixing sleeve 21 and a pressure roller 31 on the recording medium P with heat and pressure. Then, the recording medium P is discharged out of the apparatus between a pair of paper discharge rollers 99. The recording medium P discharged out of the apparatus by the pair of the paper discharge rollers 99 is sequentially stacked on a stack 100 as an output image. Thus, a series of image forming processes in the image forming apparatus 1 are completed.

Next, the fixing device 20 of the present invention is explained.

First Embodiment

Figure 2:
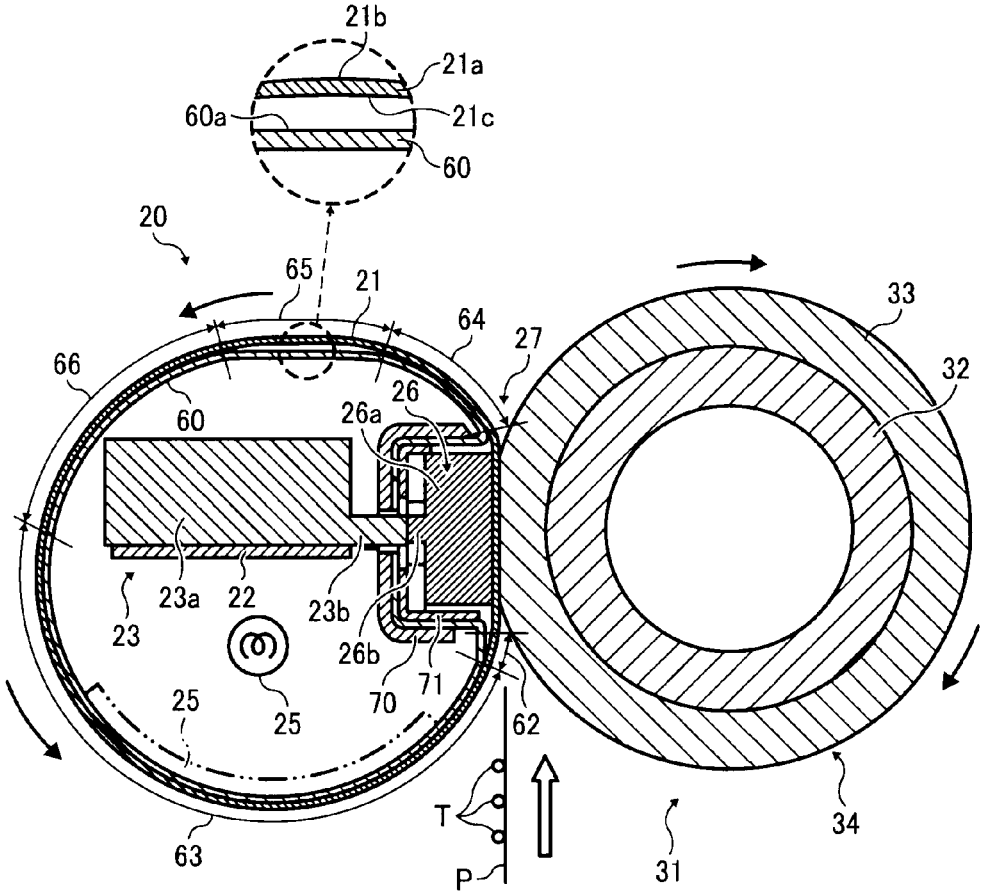
FIG. 2 is a central cross-sectional view illustrating a first embodiment of the fixing device of the present invention.
Figure 12:
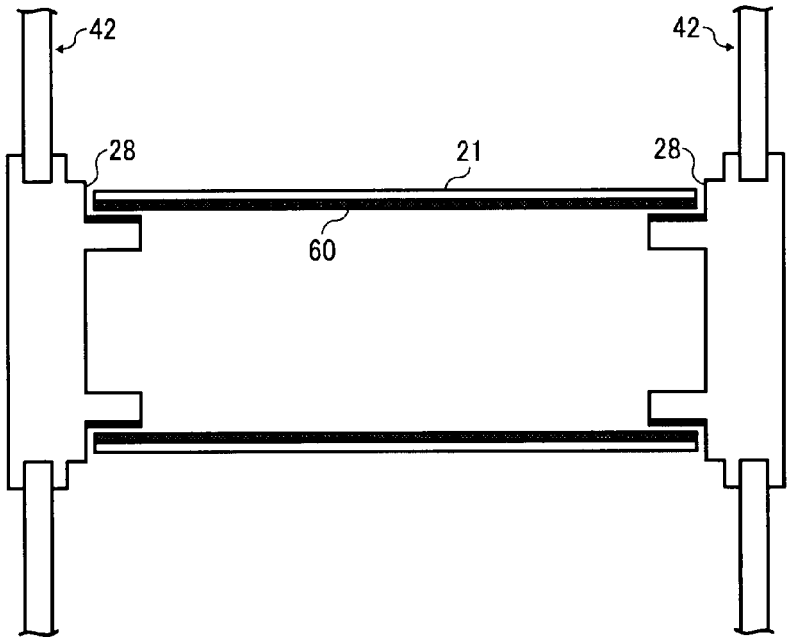
FIG. 12 is a cross-sectional view illustrating the holding member, the flange member and a chassis plate of the first embodiment of the fixing device of the present invention.

As FIG. 2 shows, the fixing device 20 includes a rotatable and flexible endless fixing belt 21, a pressure member 31 located outside in a radial direction of the fixing belt 21 and pressing inside in a radial direction thereof, a nip forming member 26 located inside in a radial direction of the fixing belt 21 and pressing the pressure member 31 each other through the fixing belt 21, a nip 27 sandwiching a recording medium P bearing toner image T between the fixing belt 21 and the pressure member 31, a tube-shaped (almost cylindrical or pipe-shaped) support (heat) member 60 located in the inner circumference of the fixing belt 21 and rotatably supporting the fixing belt 21, a heater 25 heating the support member 60 to transfer heat to the fixing belt 21, a reinforcing member 23 having the image forming apparatus 1 support the support member 60, a flange member 28 located at both ends in a longitudinal direction of the fixing device 20, and a chassis plate 42 supporting each of the flange members 28 in FIG. 12.

The fixing belt 21 includes a cylindrical iron substrate 21*a* having an inner diameter of 30 mm and a thickness of from 30 to 50 μm, a release layer 21*b* formed on the outer surface of the substrate and a coated film 21*c* formed on the inner surface thereof. An elastic layer formed of a silicone rubber having a thickness of from 100 to 300 μm is formed between the substrate 21*a* and the release layer 21*b*.

A material forming the substrate 21*a* is not limited to iron, and heat conductive metallic materials such as cobalt, nickel, stainless or their alloys, or synthetic resins such as polyimide resins can be used.

The release layer 21*b* is formed to increase releasability from toner image T on a recording medium P. The release layer 21*b* is formed of PFA (tetrafluoroethylene-perfluoroalkylvinylether copolymer resin) having a thickness of from 10 to 50 μm. A material forming the release layer 21*b* is not limited to PFA, and PTFE (polytetrafluoroethylene resin), polyimide, polyetherimide, PES (polyether sulfide), etc. can be used. The release layer 21*b* is formed to assure releasability from toner image T.

The coated film 21*c* is formed to reduce friction resistance with the support member 60. The coated film 21*c* is formed of TEFLON (registered trademark). A material forming the coated film 21*c* is not limited to TEFLON, and surface coatings such as plating, DLC (diamond-like carbon) and glass coat can be used.

Figure 3:
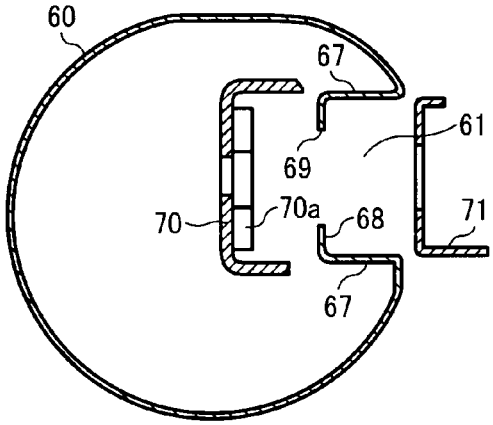
FIG. 3 is a central cross-sectional view illustrating decomposed support member, outer holding member and inner holding member of the first embodiment of the fixing device of the present invention.
Figure 4:
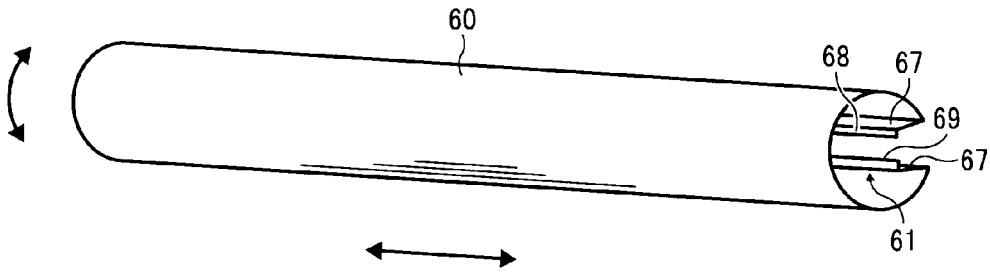
FIG. 4 is a perspective view illustrating the support member of the first embodiment of the fixing device of the present invention.
Figure 5:
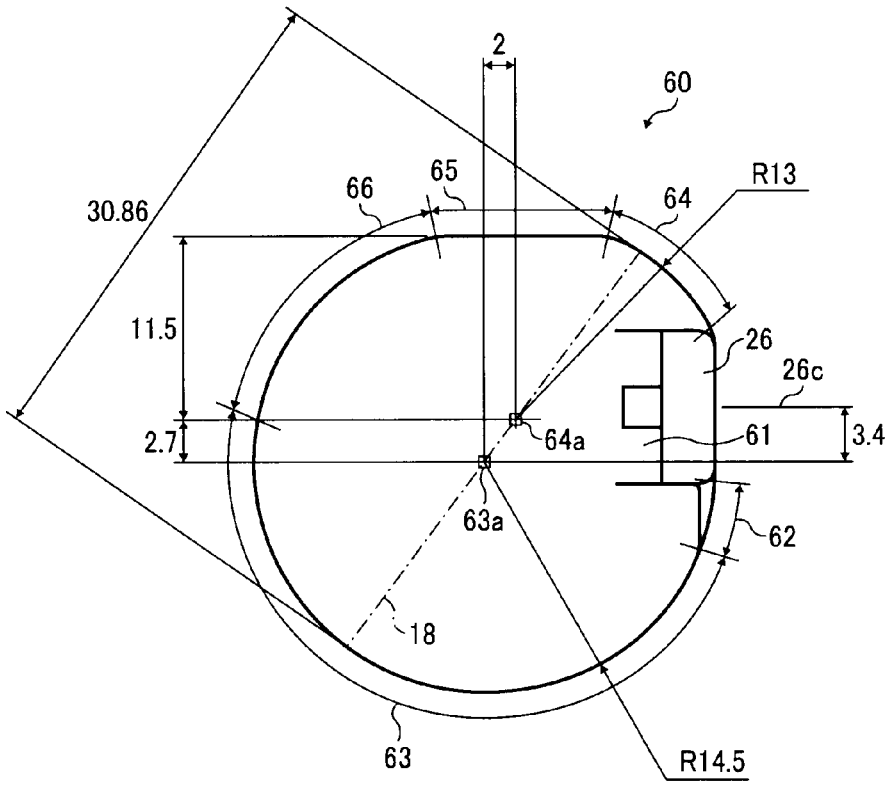
FIG. 5 is a schematic front view illustrating sizes of the support member of the first embodiment of the fixing device of the present invention.

The support member 60 is, as FIGS. 3 to 5 show, a metallic such as iron pipe having thickness of 0.1 to 1 mm and nearly a C-shaped cross-section. The support member 60 includes a nip concave 61 retracting the nip forming member 26 to form a part of the nip 27, an introduction area 62 continuously located at an upstream side of the nip concave 61 in a rotational direction of the fixing belt 21, a heated area 63 continuously located next to the introduction area 62, a separation area 64 formed at a downstream side of the nip concave 61 in a rotational direction of the fixing belt 21, a flat escape area 65 continuously located next to the separation area 64 and an intermediate area 66 continuously located at a downstream side of the flat escape area 65 in a rotational direction of the fixing belt 21 and continuously located next to the heated area 63. The support member 60 is formed by press molding.

The heated area 63 has the shape of an arc having a radius of 14.5 mm, continuously located from the nip concave 61 in a rotational direction of the fixing belt 21, and is heated by the heater 25. An arc center 63*a* of the heated area 63 is separate from a center line 26*c* of a recording medium feeding direction of the nip forming member 26 (a white arrow in FIG. 2) by 3.4 mm toward the upstream of the recording medium feeding direction. Therefore, the fixing belt 21 is drawn downstream in the recording medium feeding direction, and is difficult to separate from the heated area 63. The support member 60, particularly the heated area 63, has a black-coated inner surface. Therefore, the heater 25 improves in radiation factor of its radiation heat.

The introduction area 62 is formed to have a distance less than the radius of the heated area 63, i.e., 14.5 mm from the arc center 63*a* thereof. Namely, the introduction area 62 has a flat form having a small curvature, and continuously connects the nip concave 61 to the heated area 63. This prevents the fixing belt 21 from floating from the support member 60 near the nip 27.

The separation area 64 has an arc-shaped cross-section having a radius of 13 mm which is smaller than that of the heated area 63, i.e., 14.5 mm, where the fixing belt 21 is quickly separated from a recording medium P having passed through the nip 27. An arc center 64*a* of the separation area 64 separates from the arc center 63*a* of the heated area 63 downstream in the recording medium feeding direction by 2.7 mm and toward the nip 27 by 2 mm. A maximum outer diameter 18 passing the arc center 63*a* of the heated area 63 and the arc center 64*a* of the separation area 64 is a maximum outer diameter of the support member 60, which is 30.86 mm long and longer than the inner diameter (30 mm) of the fixing belt 21. Therefore, the fixing belt 21 is drawn between the heated area 63 and the separation area 64 and is difficult to separate from the heated area 63. Further, L2-L1 is 0.7 mm when L1 is an outer circumferential length of the support member 60 including the nip forming member 26 and L2 is an inner circumferential length of the fixing belt 21.

The intermediate area 66 has an arc-shaped cross-section having the same radius and the same center 63*a* as those of the heated area 63. Therefore, the heated area 63 and the intermediate area 66 can be formed at the same curvature, and the support member 60 can easily be modified.

The escape area 65 is a flat surface separate from the arc center 64*a* of the separation area 64 downstream in the recording medium feeding direction by 11.5 mm, and is formed between the intermediate area 66 and the separation area 64. Therefore, the support member 60 does not contact the fixing belt 21 in the escape area 65, and the friction resistance decreases.

As FIG. 2 shows, the support member 60 has an outer surface applied with a coated film 60*a*. The coated film 60*a* is formed to reduce friction resistance with the fixing belt 21. The coated film 60*a* is formed of TEFLON. A material forming the coated film 21*c* is not limited to TEFLON, and surface coatings such as plating, DLC (diamond-like carbon) and glass coat can be used. Further, grease is coated between the support member 60 and the fixing belt 21, which reduces friction resistance therebetween.

As FIG. 3 shows, the nip concave 61 includes a pair of side walls 67 parallely extending to the inner side of the support member 60, a bottom wall 68 connecting the ends of the side walls 67 and an opening 69 formed on the bottom wall 68. The nip concave 61 is equipped with an outer holding member 70 having the shape of nearly U outside, i.e., at the inner side of the support member 60, and an inner holding member 71 having the shape of nearly U inside, i.e., at the outer side of the support member 60. The outer holding member 70 and the inner holding member 71 are threadably mounted, sandwiching the side walls 67 and the bottom wall 68 of the nip concave 61 in the support member 60. The outer holding member 70 and the inner holding member 71 maintain the shape of the nip concave 61. The outer holding member 70 has attaching portions 70*a* at both ends in a longitudinal direction. The attaching portions 70*a* are fixed on the support member 60 with the flange members 28.

Figure 6:
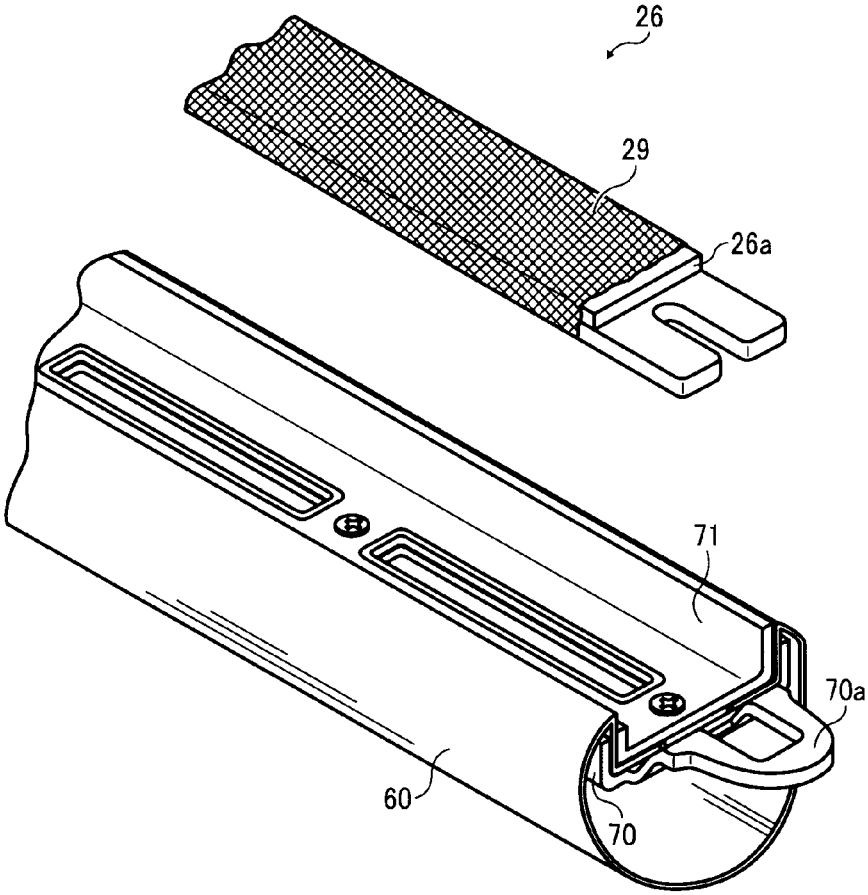
FIG. 6 is a perspective view illustrating a dismounted nip forming member of the first embodiment of the fixing device of the present invention.
Figure 7:
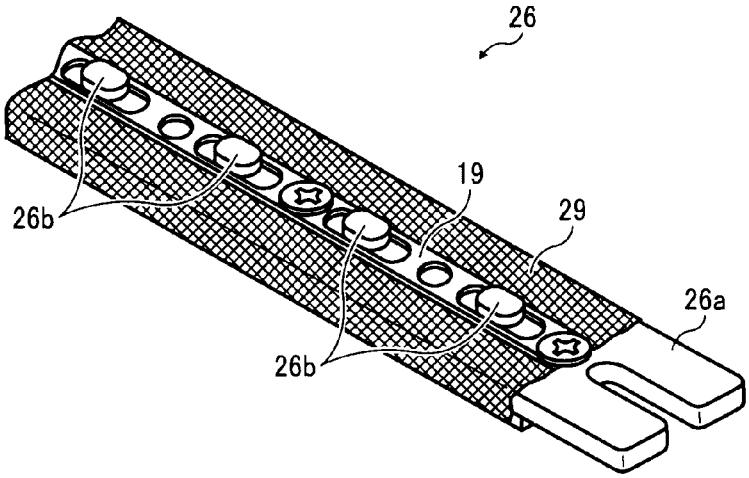
FIG. 7 is a perspective view illustrating a backside of the nip forming member of the first embodiment of the fixing device of the present invention.

As FIGS. 2, 6 and 7 show, the nip forming member 26 is located at the inner side of the inner holding member 71. The nip forming member 26 is formed of a heat-resistant resin such as LCP (liquid crystal polymers), polyimide resins and PAI (polyamide-imide resins), and nearly a square bar along a longitudinal direction of the support member 60. The nip forming member 26 includes a main body 26*a* facing the pressure member 31, a support projection 26*b* contacting the reinforcing member 23 to be supported at the back of the main body 26*a* and a film member 29 on the circumference of the main body 26*a*.

When the main body 26*a* is pressed by the pressure member 31, the support projection 26*b* contacted and supported by the reinforcing member 23 prevents the main body 26*a* from being pressed into by the pressure member 31.

The nip forming member 26 has a flat surface toward the pressure member 31, and may have a concave shape along the surface of the pressure member 31.

The film member 29 is formed of a fabric of a PTFE fiber, and reduces friction resistance with the fixing belt 21. The film member 29 is wound around the main body 26*a* and is fixed while sandwiched between a stopping member 19 threadably mounted near the support projection 26*b* and the main body 26*a*. The nip forming member 26 is fixed on the support member 60 with the flange members 28.

Figure 8:
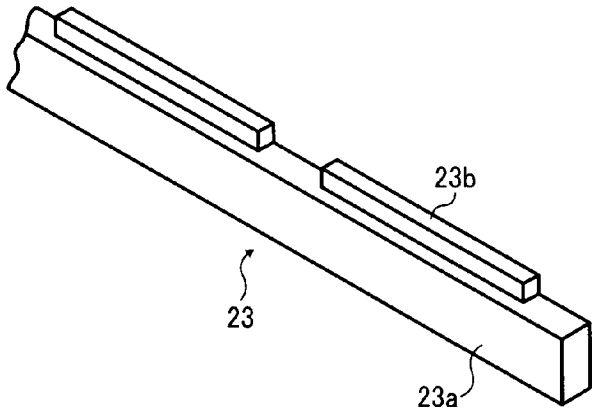
FIG. 8 is a perspective view illustrating a reinforcing member of the first embodiment of the fixing device of the present invention.

As FIGS. 2 and 8 show, the reinforcing member 23 is a metallic and nearly square bar along a longitudinal direction of the support member 60, and includes a main body 23*a* having high rigidity, a receiving projection 23*b* contacting the support projection 26*b* of the nip forming member 26 and a reflection board 22 facing the heater 25. The receiving projection 23*b* contacts the support projection 26*b* of the nip forming member 26 and support the nip forming member 26 pressed by the pressure member 31 from behind. The reflection board 22 reflects radiation heat from the heater 25 and reduces heat quantity escaping to the main body 23*a* of the reinforcing member 23. The reinforcing member 23 is fixed on the support member 60 with the flange members 28.

The heater 25 is a linear heating element located along a longitudinal direction of the support member 60 therein, and a halogen heater in the present invention. The heater 25 is located at the inner side of the heated area 63. Therefore, the heated area 63 is a radiated area a heat from the heater 25 is radiated to without being interrupted with the reinforcing member 23. A temperature sensor is located at a proper position in the heated area 63 to detect a temperature of the fixing belt 21.

Figure 9:
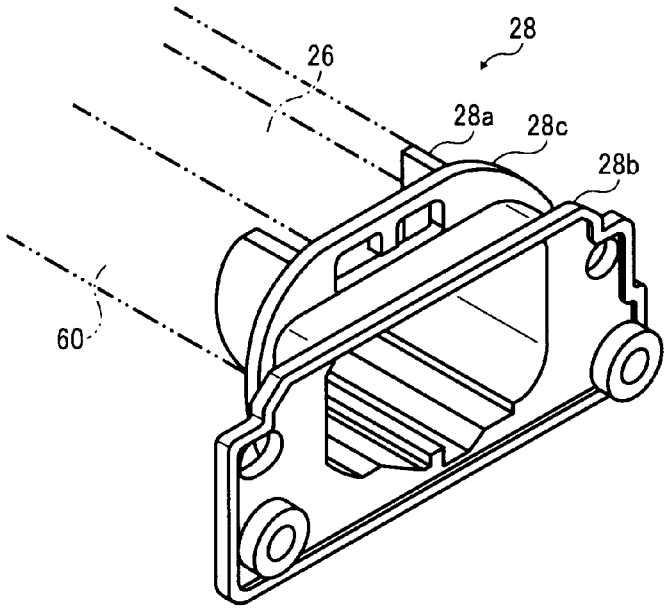
FIG. 9 is a perspective view illustrating a flange member of the first embodiment of the fixing device of the present invention.

As FIG. 9 shows, the flange member 28 is inserted into bores at both ends of the support member 60 in its axial direction; includes a cylinder 28*a* holding the shape near the end of the support member 60 and a flange 28*b* fixed on the chassis plate 42 of the fixing device 20; and holds and fixes the nip forming member 26, the outer holding member 70, the reinforcing member 23 and the heater 25. In addition, the flange member 28 regulates movement of the fixing belt 21 in its axial direction with a brim 28*c*.

As mentioned above, the support member 60 has a predetermined cross-sectional shape for obtaining predetermined functions such as closely contacting the fixing belt 21 at the heated area 63 to efficiently heat the belt and separability with a recording medium P at the separation area 64, but tends to have uneven processed shapes or deform due to friction with the fixing belt 21 and lose initial functions because of a thin metallic pipe. The outer circumference of the cylinder 28*a* of the flange member 28 holds the shape near the end of the support member 60 as mentioned above to stably obtain the initial functions (details are mentioned later). Therefore, a clearance between the outer circumferential surface of the cylinder 28*a* and an inner circumferential surface at the end of the support member 60 is not greater than 0.15 mm.

The pressure member 31 is a pressure roller having an outer diameter of 30 mm, and includes a metallic pipe-shaped central shaft 32, an elastic layer 33 formed of a heat-resistant silicone rubber around the shaft and a release layer 34 formed of PFA on the surface. The elastic layer 33 has a thickness of from 2 to 4 mm. The release layer 34 is a PFA tube having a thickness. The central shaft 32 may include a heating element such as halogen heaters when necessary.

The pressure member 31 is pressed by an unillustrated pressurizer toward the nip forming member 26 through the fixing belt 21. When the pressure member 31 is pressed to the nip forming member 26 through the fixing belt 21 to from the nip 27. The pressure member 31 is rotated by an unillustrated driver while pressing the fixing belt 21 (in an arrow direction in FIG. 2). With the rotation, the fixing belt 21 rotates and a recording medium P is transferred while pressurized at the nip 27.

Next, an operation is explained.

A user requests for printing by operating an operation panel or a computer.

When the image forming apparatus receives an output signal through this printing request, the pressure member 21 is rotated by a driver and the fixing belt rotates therewith.

The arc center 63*a* of the heated area 63 is located upstream in the recording medium feeding direction relative to a central line of a recording medium feeding direction of the nip forming member 26, and the fixing belt 21 is drawn downstream in the recording medium feeding direction, i.e., to the opposite side of the heated area 63. Therefore, the support member 60 contacts the fixing belt 21 closer at the heated area 63 and the fixing belt 21 is difficult to leave from the support member 60. The heated area 63 has the shape of an arc having a radius of 14.5 mm as a cross-sectional shape, which is almost same as that of the fixing belt 21 having a radius 15 mm. Therefore, the support member 60 contacts the fixing belt 21 closer, applying almost no deformation force thereto at the heated area 63. Further, a maximum outer diameter 18 of 30.86 mm between the heated area 63 and the separation area 64 is larger than the inner diameter of 30 mm of the fixing belt 21, and the fixing belt 21 is drawn between the heated area 63 and the separation area 64. Therefore, the support member 60 contacts the fixing belt 21 closer at the heated area 63 and the fixing belt 21 is difficult to leave from the support member 60. This is why the fixing belt 21 closely slides on the support member 60 at the heated area 63.

Meanwhile, the heater 25 produces heat when applied with current in synchronization with rotation of the pressure member 31. The heat of the heater 25 is radiated to the heated area 63 to be quickly heated. The rotation of the pressure member 31 and heating of the heater 25 do not necessarily start at the same time, and may have a time difference. The temperature sensor detects a temperature of the fixing belt 21, the nip 27 is heated to have a temperature needed to fix, and recording media P start rotation while the temperature is maintained. Toner image on a recording medium P having passed the nip 27 is fixed thereon with pressure and heat at the nip 27.

An mentioned above, in the image forming apparatus of the present invention, the support member 60 contacts the fixing belt 21 closer at the heated area 63 and the fixing belt 21 is difficult to leave from the support member 60. Therefore, a heat conductivity from the support member 60 to the fixing belt 21 increases to prevent the support member 60 from being overheated and the coated films 60*a* and 21*c* from deteriorating. Further the support member 60 contacts the fixing belt 21 closer to shorten a warm-up time and a first print time, and improve energy efficiency.

In the present invention, the separation area 64 has the shape of an arc having a radius smaller than that of the heated area as a cross-sectional shape, and the fixing belt 21 is quickly separated from a recording medium P. Therefore, separability of a recording medium P improves after passing the nip 27.

Figure 11:
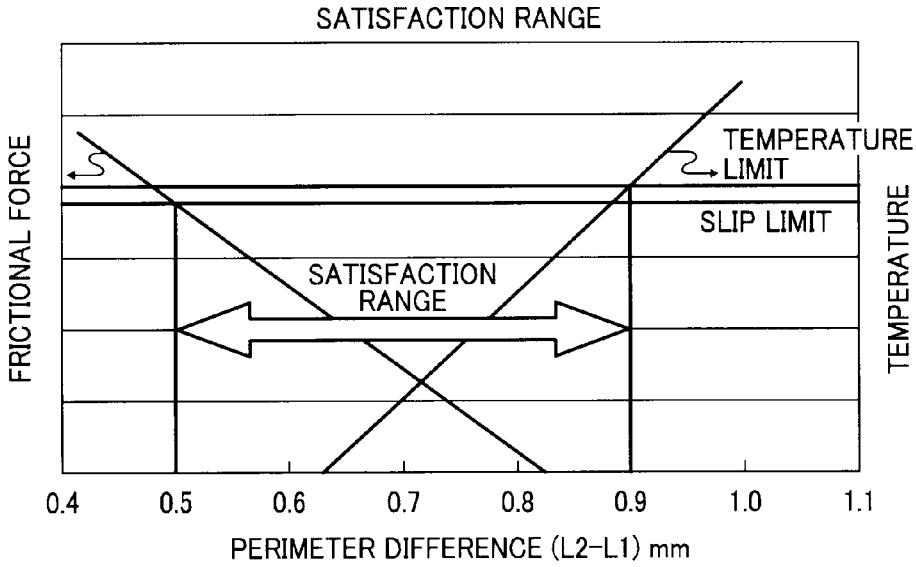
FIG. 11 is a diagram showing relationships among a perimeter difference, a frictional force and a temperature when using the support member in FIG. 5 and a fixing belt having a diameter of 30 mm.

In the present invention, L2-L1 is from 0.5 to 0.9 mm when the support member 60 including the nip forming member 26 has an outer circumferential length L1 and the fixing belt 21 has an inner circumferential length L2 (FIG. 11). When greater than 0.9 mm, the fixing belt 21 is loosely wound around the support member 60 to partially be overheated, resulting in deterioration of durability of the coated film. When less than 0.5 mm, the fixing belt 21 is tightly wound around the support member 60 and a frictional force therebetween becomes so large that the fixing belt 21 is difficult to rotate. In addition, the pressure member 31 and a recording medium P become easy to slip on the fixing belt 21. Therefore, when L2-L1 is from 0.5 to 0.9, the fixing belt 21 does not float free of the support member 60, which prevents the support member 60 from being overheated. Further, the fixing belt 21 is not so tightly wound around the support member 60, which prevents a recording medium P from slipping.

In the present invention, the fixing belt 21 is drawn between the heated area 63 and the separation area 64, and the support member 60 contacts the fixing belt 21 closer at the heated area 63 even when the fixing belt 21 stops. Therefore, when the fixing belt 21 is heated still, it is efficiently heated without overheating the support member 60.

Further, in the present invention, the heater 25 is a linear heating element along the support member 60, located internally therein, and the fixing device 20 can be simplified because the linear heating element has a simple mounting structure. The inner surface of the support member 60 is painted black, which improves in radiation factor therein to shorten a warm-up time and a first print time, and improve energy efficiency.

In the present invention, between the heated area 63 and the nip forming member 26, an introduction area 62 is located at a distance less than 14.5 mm which is a radius of the heated area 63 from the center of the arc 63*a* of the heated area 63 as a cross-sectional shape, which prevents the fixing belt 21 from floating out of an outer surface of the support member 60 and the support member 60 from being overheated.

In the present invention, the intermediate area 66 has the shape of an arc having same radius and the same center 63*a* as those of the heated area 63 as a cross-sectional shape, and the heated area 63 and the intermediate area 66 can be formed at the same curvature. Therefore, the support member 60 can easily be processed, which reduces production cost.

Further, in the present invention, the flat escape area 65 is located between the intermediate area 66 and the separation area 64, and the support member 60 and the fixing belt 21 do not contact each other in the flat escape area 65. A friction resistance therebetween decreases to be further smaller than that between the fixing belt 21 and a recording medium P, which prevents a recording medium P from slipping on the fixing belt 21. In addition, a material for forming the support member 60 can be shortened, which reduces material cost.

In the present invention, the inner surface of the fixing belt 21 and an outer surface of the support member 60 are both coated with coated films 21*c* and 60*a*, respectively, and grease is applied therebetween. A friction resistance at a sliding part therebetween decreases to be smaller than that between the fixing belt 21 and a recording medium P, which prevents a recording medium P from slipping on the fixing belt 21.

In the image forming apparatus of the present invention, L2-L1 is 0.7 mm when the support member 60 including the nip forming member 26 has an outer circumferential length L1 and the fixing belt 21 has an inner circumferential length L2, but which is not limited to this.

Namely, when greater than 0.9 mm, the fixing belt 21 is loosely wound around the support member 60 to partially be overheated, resulting in deterioration of durability of the coated film. When less than 0.5 mm, the fixing belt 21 is tightly wound around the support member 60 and a frictional force therebetween becomes so large that the fixing belt 21 is difficult to rotate. In addition, the pressure member 31 and a recording medium P become easy to slip on the fixing belt 21.

Therefore, L2-L1 is preferably from 0.5 to 0.9 mm, more preferably from 0.6 to 0.8 mm, and most preferably 0.7 mm, which prevents the support member 60 from being overheated and a recording medium P from slipping. However, L2-L1 is not limited to 0.5 to 0.9 mm and can properly be determined according to whether the coated films 21*c* and 60*a* or grease is coated, or shapes and sizes of the components.

In the image forming apparatus of the present invention, the intermediate area 66 of the support member 60 of the fixing device 20 has the shape of an arch having the same radius and the same center 63*a* as those of the heated area 63 as a cross-sectional shape. However, the intermediate area 66 is not limited thereto, and may have a distance from the center of the arc 63*a* of the heated area 63 smaller than the radius thereof unless interfering with the reinforcing member 23. In the intermediate area 66, the support member 60 and the fixing belt 21 do not contact each other. A friction resistance therebetween decreases to be further smaller than that between the fixing belt 21 and a recording medium P, which prevents a recording medium P from slipping on the fixing belt 21. In addition, a material for forming the support member 60 can be shortened, which reduces material cost.

In the image forming apparatus of the present invention, the fixing belt 21 of the fixing device 20 has a diameter of 30 mm. However, the diameter is not limited thereto and may be from 15 to 120 mm, and preferably be 25 mm.

Further, in the image forming apparatus of the present invention, the heater 25 of the fixing device 20 is a linear heating element such as halogen heaters. However, the heater is not limited thereto, and may be a sheet heating element along a longitudinal direction of the support member 60, contacting the inner surface thereof as shown by virtual lines in FIG. 2.

Figure 10:
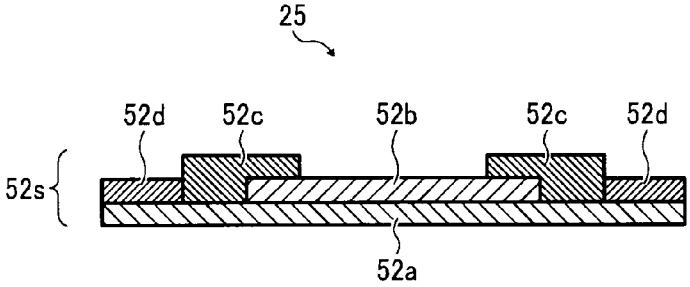
FIG. 10 is a cross-sectional view illustrating a heater formed of a sheet heating element.

The sheet heating element, e.g., as FIG. 10 shows, includes a flexible heating sheet 52*s* having a predetermined width and length according to an axial direction and a circumferential direction of the fixing belt 21. The heating sheets 52*s* includes an insulative base layer 52*a*, a resistance heating layer 52*b* in which an electroconductive particulate material is dispersed in a heat resistant resin, and an electrode layer 52*c* providing an electric power to the resistance heating layer 52*b*. An insulative layer 52*d* insulating interfaces between the resistance heating layer 52*b* and the adjacent electrode layer 52*c*, and the flexible heating sheet 52*s* and the outside is located. The sheet heating element is connected to the electrode layer 52*c* at the end of the heating sheets 52*s* and has an electrode terminal providing electric power fed from an electric supply line to the electrode layer 52*c*. The sheet heating element is not limited to have this configuration, and may have other configurations.

When the sheet heating element is used instead of the linear heating element, the heated area 63 is a contact area a heat from the heater 25 formed of the sheet heating element is conducted to. The sheet heating element can efficiently heat the support member 60 to shorten a warm-up time and a first print time, and improve energy efficiency.

Alternatively, the heater 25 may be an induction coil located at an outside or an inside of the support member 60 to inductively heat the support member 60. In this case, the heated area 63 is a facing area inductively heated facing the heater 25. The induction heating does not directly heat the others such as the reinforcing member 23 besides the support member 60, and can efficiently heat the support member 60.

EXAMPLES

Under the same above-mentioned conditions, using the support member 60 having the size and shape in FIG. 5, various measurements were made with different differences of circumferential lengths L2-L1 between the outer circumferential length of the support member 60 including the nip forming member 26 L1 and the inner circumferential length of the fixing belt 21 L2. The measurements were made on a relation between the difference of circumferential length and a surface temperature of the support member 60, and a relation between the difference of circumferential length and frictional forces of the support member 60 and the fixing belt 21.

The results are shown in FIG. 11. As FIG. 11 shows, when the difference of circumferential length was greater than 0.9 mm, the surface temperature of the support member 60 was over a predetermined limit value. It was assumed this is because the fixing belt 21 is loosely wound around the support member 60 and floats, and the support member 60 is partially overheated. Therefore, it was proved that the coated film 60*a* is likely to deteriorate in durability when the support member 60 is overheated.

When the difference of circumferential length is less than 0.5 mm, a frictional force between the support member 60 and the fixing belt 21 was over a predetermined limit value. Namely, it was assumed that this is because the fixing belt 21 is tightly wound around the support member 60 and a frictional force therebetween becomes so large that a slip value between the pressure member 31 and a recording medium P was over the limit. It was proved that the fixing belt 21 is difficult to rotate and the pressure member 31 and a recording medium P become easy to slip on the fixing belt 21.

Base on these results, it was proved that the difference of circumferential length between the inner circumferential length of the fixing belt 21 and the outer circumferential length of the support member 60 is preferably 0.5 to 0.9 mm, more preferably from 0.6 to 0.8 mm, and most preferably 0.7 mm. This was proved to prevent a recording medium P from slipping while prevent the support member 60 from being overheated.

Meanwhile, the flange member 28 is inserted and fixed in bores at both ends of the support member 60 in an axial direction thereof; and holds the nip forming member 26, the outer holding member 70, the reinforcing member 23 and the heater 25. Further, the fixing belt is rotatably mounted on an outer circumference of the support member 60. A component including these members is detachable from the chassis plate 42 of the fixing device 20, and called a fixing belt unit.

Figure 13:
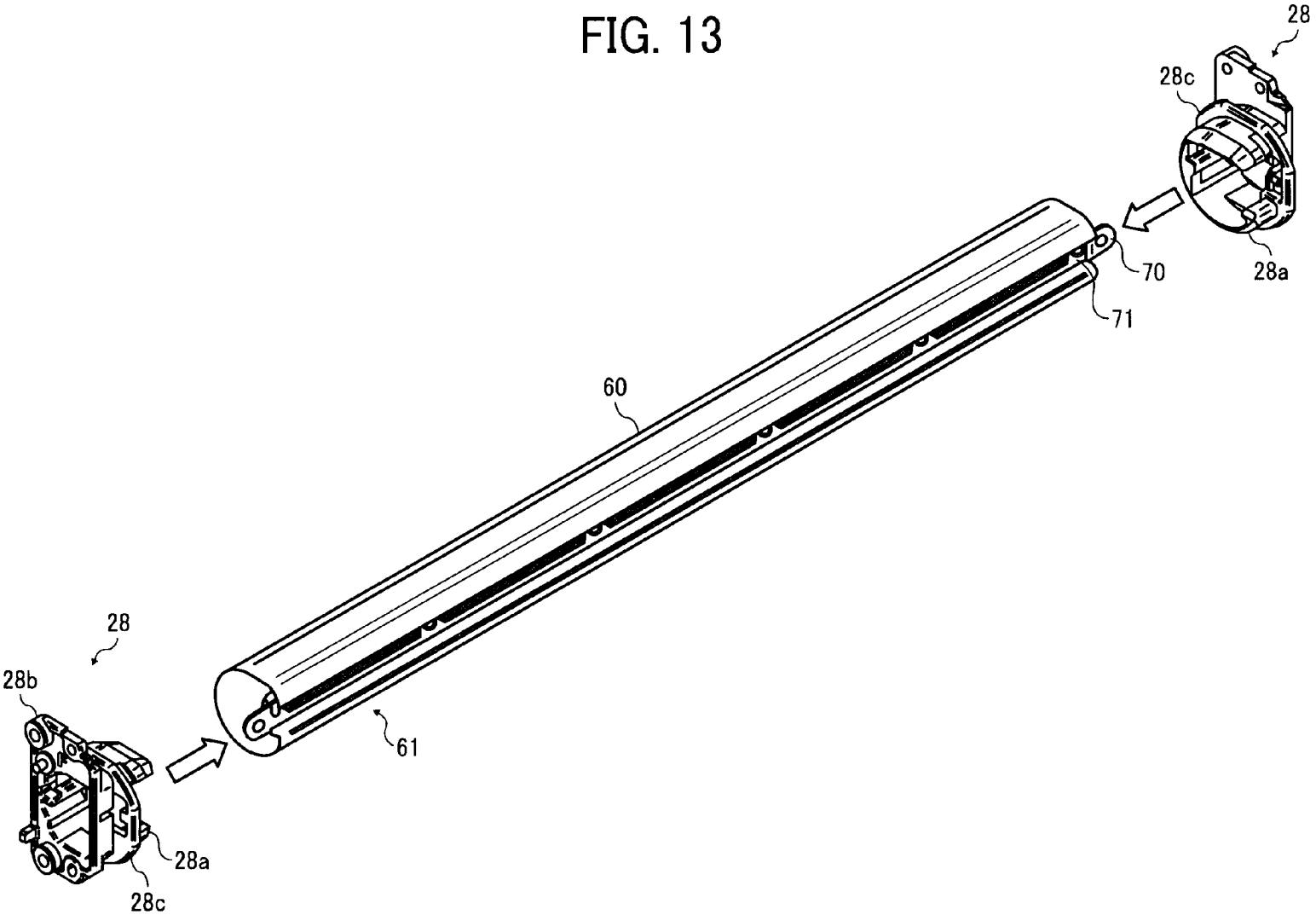
FIG. 13 is a cross-sectional view illustrating the flange member is being inserted into the holding member.
Figure 14A:
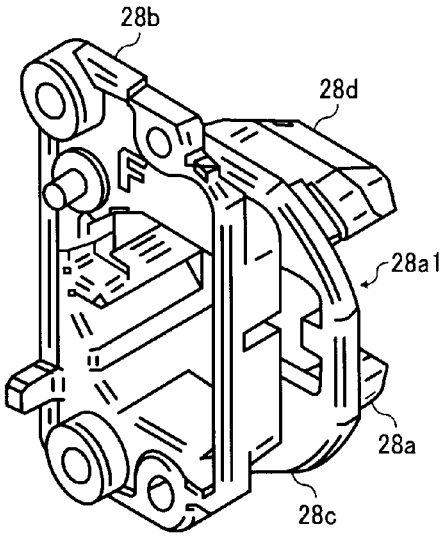
FIG. 14 is a cross-sectional view illustrating appearance configurations of a pair of the flanges.
Figure 14B:
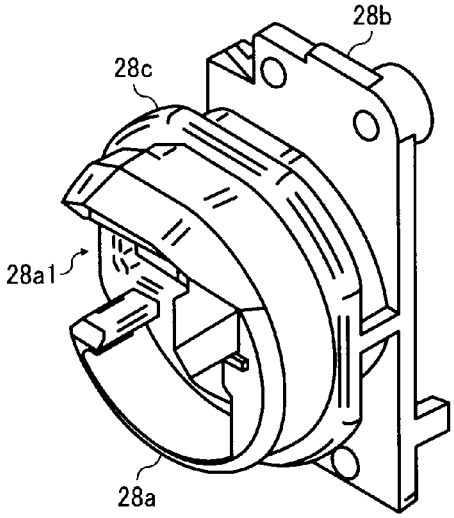
Figure 14C:
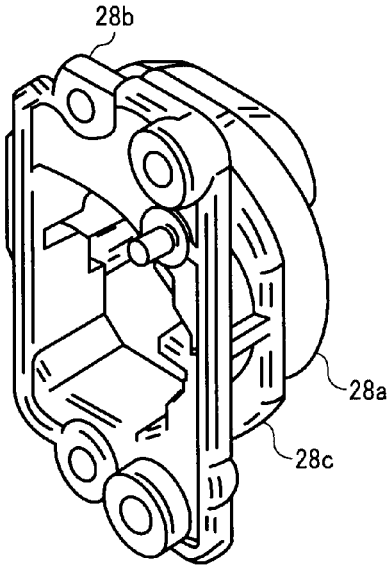
Figure 14D:
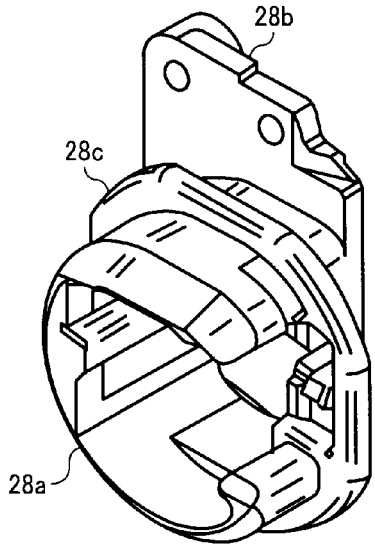

The fixing belt unit is composed as follows (ref. FIG. 13).

(S11) First, the cylinder 28*a* of the flange member 28 is inserted into a bore of an end (right end in FIG. 13) of the support member 60 equipped with the outer holding member 70 and the inner holding member until the brim 28*c* of the cylinder 28*a* contacts the end of the support member 60.

(S12) Next, the fixing belt 21 is mounted on the outer circumference of the support member 60, and the nip forming member 26 is inserted into the nip concave 61 of the support member 60 until an end of the nip forming member 26 contacts a predetermined position of the flange 28*b*. The reinforcing member 23 and the heater 25 are inserted into a bore of the support member 60 until their ends contact a predetermined position of the flange 28*b* (omitted in FIG. 13).

(S13) Finally, the cylinder 28*a* of the other flange member 28 is inserted into a bore of the other end (left end in FIG. 13) of the support member 60 until the brim 28*c* of the cylinder 28*a* contacts the end of the support member 60 to complete the fixing belt unit.

The flange members 28 used in the fixing device 20 have the same sized and mirror image (symmetrical) shapes as FIG. 14 shows.

Then, the flanges 28*b* of the flange members 28 at both ends of the fixing belt unit are fixed on predetermined positions of a pair of the chassis plates 42, respectively to install the fixing belt unit.

As mentioned above, the support member 60 has a predetermined cross-sectional shape for obtaining predetermined functions such as closely contacting the fixing belt 21 in the heated area 63 to efficiently heat the fixing belt 21, and assuring separability of a recording medium P in the separation area 64. The support member 60 is prepared by pressing a thin metallic plate such as stainless having a thickness of 0.1 mm, and external dimensions were difficult to precisely maintain. Uneven sizes of the support member 60 caused uneven performance thereof. Particularly, when the maximum outer diameter 18 in FIG. 5 of 30.86 mm became shorter by a certain level, the fixing belt 21 and the support member 60 did not contact each other at a downstream side of the nip, and the fixing belt 21 unstably moved, resulting in deterioration of the separability of a recording medium P and a local float of the fixing belt 21. Further, when the fixing belt 21 rotated, the position of the support member 60 shifted by a friction with the rotation thereof.

The present inventors keenly studied such that the flange member 28 holding both ends of the support member 60 should stabilize the shape thereof, movement thereof when the fixing belt is driven, and the shape of the fixing belt 21 to find the present invention.

Hereinafter, main configurations of the present invention are explained.

Figure 15:
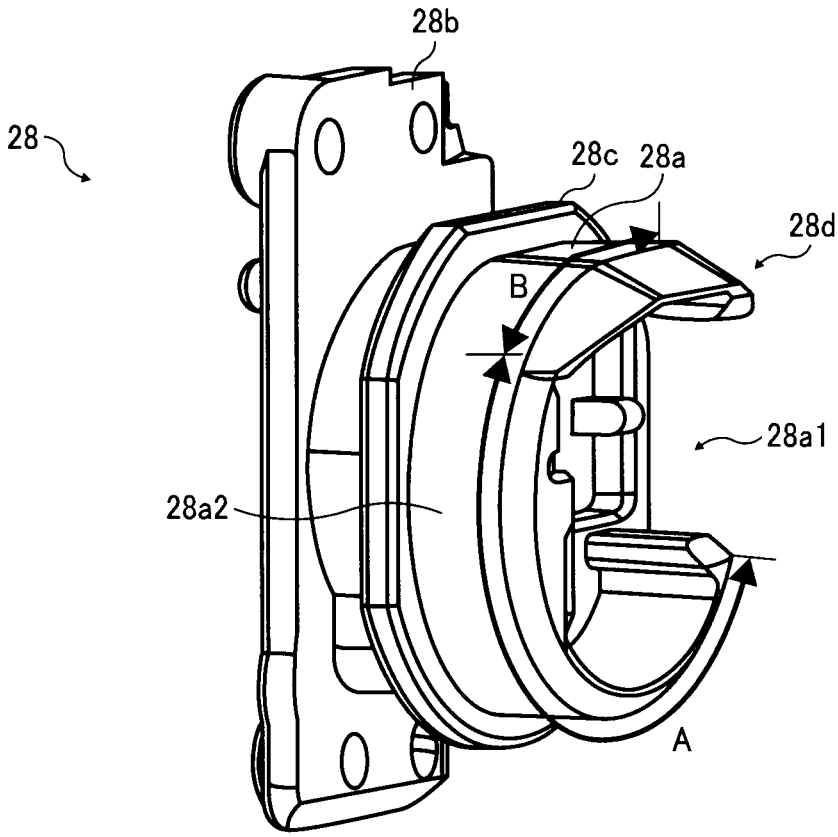
FIG. 15 is a perspective view illustrating details of the flange member used in the fixing device of the present invention.

FIG. 15 is a perspective view illustrating configurations of the flange member 28 used in the fixing device 20 of the present invention.

As FIG. 15 shows, the flange member 28 includes a cylinder 28*a* inserted into bores at both ends of the support member 60 and holding the shape near the end of the support member 60, a flange 28*b* fixed on the chassis plate 42 of the fixing device 20, and a brim 28*c* which is a far end of the end of the support member 60 in an axial direction when mounted and a rest point of the fixing belt 21 when the apparatus is driven.

The cylinder 28*a* has a notch 28*a*1 for placing the nip forming member 26 and the nip concave 61 of the support member on a part of its circumference. The attaching portion 70*a* of the outer holding member 70 maintaining the shapes of the nip forming member 26 and the nip concave 61 is held by the flange 28*b*.

The cylinder 28*a* has a shape holding surface 28*a*2 holding a desired cross-sectional shape of a vicinity of the end of the support member in its axial direction in an area A at least adjacent to an entrance of the nip of the notch 28*a*1 on the outer circumference. The area A is a corresponding area (63' mentioned later) to the heated area 63 in the support member 60. Therefore, the shape holding surface 28*a*2 is an outer circumferential surface precisely holding the above-mentioned predetermined shape of the heated area 63 in the vicinity of the end of the support member in its axial direction.

The end of the cylinder 28*a* in its axial direction is chamfered so as to be easily inserted into a bore of the end of the support member 60 in its axial direction.

The cylinder 28*a* has a guide 28*d* located on a part of its circumference in its axial direction and on the outer circumference thereof, and formed of an inclined surface inclining to the center of the cylinder as the guide 28*d* heads for the end of the cylinder 28*a*. The guide 28*d* enables the cylinder 28*a* of the flange member 28 to easily insert into a bore of the end of the support member 60 in its axial direction.

The guide 28*d* is preferably located in an area B besides the shape holding surface 28*a*2 on a circumference of the cylinder 28*a*. Namely, the area B is at least an area corresponding to the escape area 65 in the support member 60, and may include a part of each of the separation area 64 and the intermediate area 66. The guide 28*d* is located at a downstream side of the nip in a rotational direction of the fixing belt 21 on the circumference of the cylinder 28*a*, and in an area opposite to the heater 25 through the reinforcing member 23 in FIG. 2.

The present invention includes, as mentioned above, the nearly cylindrical support member 60 which is heated by the heater 25 at an inner circumferential side of the fixing belt 21 and frictionally contacts its outer circumferential surface to an inner circumferential surface of the fixing belt 21 to heat the belt, and supports the rotation of thereof. The flange member 28 inserts the cylinder 28*a* into an inner circumference of the support member 60 at the end thereof in its axial direction to maintain a shape near the end thereof in its axial direction by an outer circumferential surface of the cylinder 28*a*.

The cylinder 28*a* preferably has an outer circumferential shape (a cross-sectional shape of the outer circumferential surface) having almost a same shape of an inner circumference at the heated area 63 of the support member 60, which corresponds to an area of the fixing belt 21 heated by the heater 25, and preferably has almost same shape and sizes of the inner circumference of the support member 60 so as to maintain the above-mentioned desired shape and sizes in FIG. 5.

Namely, the cylinder 28*a* of the flange member 28 has cross-sectional shape of its outer circumferential surface, having the shape of an arc and a predetermined radius corresponding to a radius of the fixing belt 21, which is the area A and the corresponding heated area 63' corresponding to an area of the fixing belt 21 heated by the heater 25. In the present invention, the arc has nearly a same radius as that of an inner circumference of the support member 60. The center of the arc is located at an upstream side in a recording medium feeding direction relative to the center line 26*c* of the nip forming member 26 in the recording medium feeding direction.

As the cross-sectional shape of an outer circumferential surface of the cylinder 28*a* of the flange member 28, a nip entrance area (the corresponding heated area 63') preferably projects to an outer direction of the cylinder diameter more than a nip exit area (the corresponding separation area 64') relative to the center line 26*c* of the nip forming member 26 in the recording medium feeding direction.

Further, as the cross-sectional shape of an outer circumferential surface of the cylinder 28*a* of the flange member 28, a corresponding flat escape area 65' is preferably located at a downstream side in a rotational direction of the fixing belt 21 relative to the nip exit area (the corresponding separation area 64').

Figure 16:
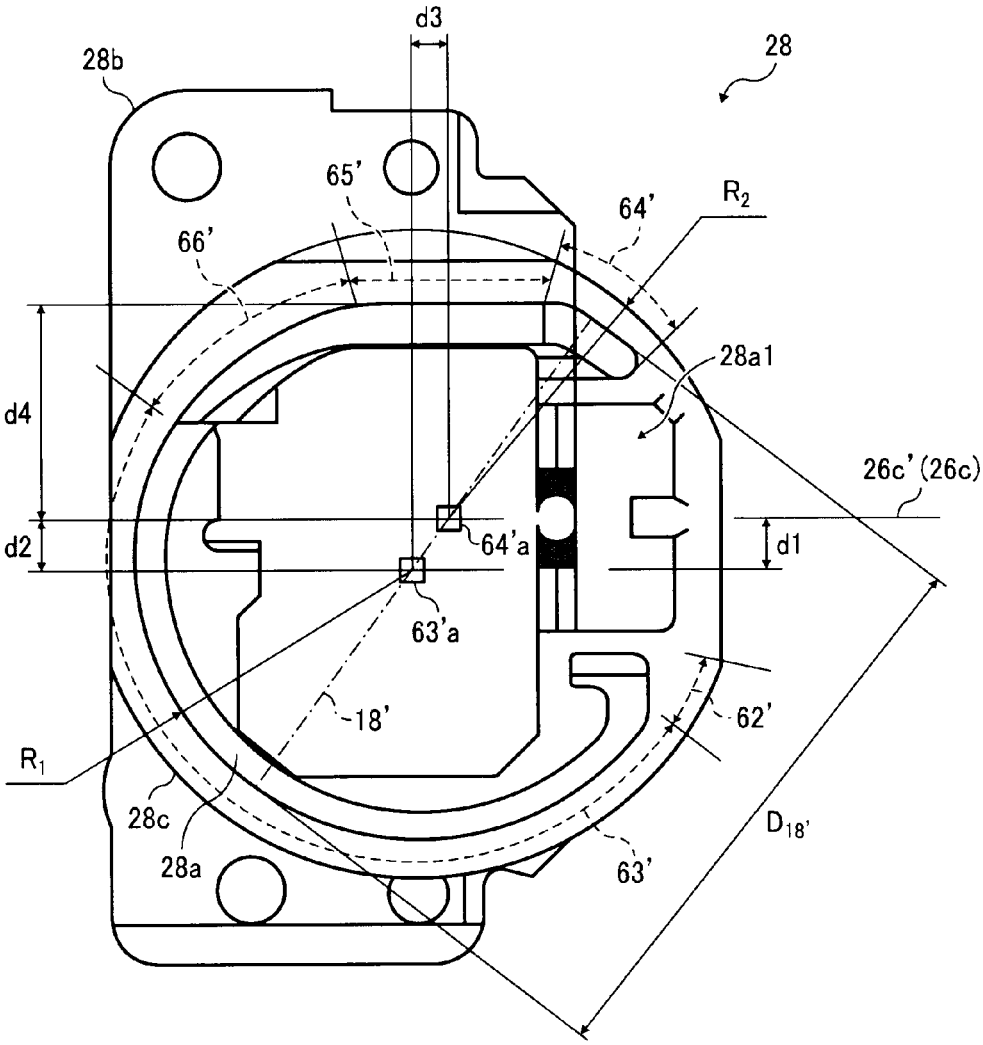
FIG. 16 is a front view illustrating a shape and sizes of a cylinder of the flange member in FIG. 15.

FIG. 16 is a front view illustrating a specific outer circumferential shape of the cylinder 28*a* of the flange member 28.

As FIG. 16 shows, the cylinder 28*a* includes the notch 28*a*1 corresponding to the nip concave 61 and containing the nip forming member 26, a corresponding introduction area 62' continuously located at an upstream side of the rotational direction of the fixing belt 21, a corresponding heated area 63' continuously located to the corresponding introduction area 62', the corresponding separation area 64' located at a downstream side of the rotational direction of the fixing belt 21, the flat corresponding escape area 65' continuously located to the corresponding separation area 64', and a corresponding intermediate area 66' continuously located to the corresponding escape area 65' at a downstream side of the rotational direction and the corresponding heated area 63'.

The corresponding heated area 63' has the shape of a cross-sectional arc having a radius R1, continuously located from an upstream side of the notch 28*a*1 in its rotational direction, and is corresponding to an area of the support member 60, heated by the heater 25. An arc center 63*a'* of the corresponding heated area 63' separates from a center line 26*c'* of the notch 28*a*1 by a distance d1 in a recording medium feeding direction, i.e., the center line 26*c* of the nip forming member 26 in the recording medium feeding direction. Thus, the corresponding heated area 63' properly supports the heated area 63 at an end vicinity of the support member 60 in its axial direction.

The radius R1 is, e.g., 14.3 mm and the distance d1 is, e.g., 2.7 mm.

The corresponding introduction area 62' is formed to have a cross-sectional shape with a distance from the arc center 63*a'* less than the radius R1. Namely, the corresponding introduction area 62' has a flat shape having a small curvature and supports the introduction area 62 at an end vicinity of the support member 60 in its axial direction.

The corresponding separation area 64' has the shape of an arc as a cross-sectional shape, having a radius R2 less than the radius R1, and supports the separation area 64 of the support member 60. Further, the corresponding separation area 64' supports a nip exit part of the support member 60 so as not to contact the pressure roller 31 without deforming the nip exit part. An arc center 64*a'* of the corresponding separation area 64' separates from the arc center 63*a'* of the corresponding heated area 63' by a distance d2 at a down stream side in a recording medium feeding direction and a distance d3 at a side of the notch 28*a*1 (the nip 27). Thus, a maximum outer diameter 18' from the arc center 63*a'* of the corresponding heated area 63' through the arc center 64*a'* of the corresponding separation area 64' is a maximum outer diameter of the cylinder 28A, and the maximum outer diameter 18' ($D_{18}$') supports the support member 60 such that the maximum outer diameter 18 thereof is larger than the inner diameter 30 mm of the fixing belt 21. Further, near the end of the support member 60 in its axial direction, the cylinder 28*a* supports the support member 60 such that the difference of circumferential length L2-L1 is 0.7 mm when L1 is an outer circumferential length of the support member 60 including the nip forming member 26 and L2 is an inner circumferential length of the fixing belt 21.

The radius R2 is, e.g., 12.8 mm, the distances d2 and d3 are, e.g., 2.7 mm and 2 mm, respectively, and the $D_{18}$' is, e.g., 30.46 mm.

The corresponding intermediate area 66' has the shape of an arc as a cross-sectional shape, having the same radius as that of the corresponding heated area 63' and the same center 63*a'*.

The corresponding flat escape area 65' is a flat surface separated from the arc center 64*a'* of the corresponding separation area 64' by a distance d4 at a downstream side in a recoding medium feeding direction, and is located between the corresponding intermediate area 66' and the corresponding separation area 64'. Thus, the corresponding flat escape area 65' supports the support member 60 at the escape area 65 near the end of the support member 60 in its axial direction such that the support member 60 and the fixing belt 21 do not contact each other.

The distance d4 is, e.g., 11.3 mm.

Figure 17:
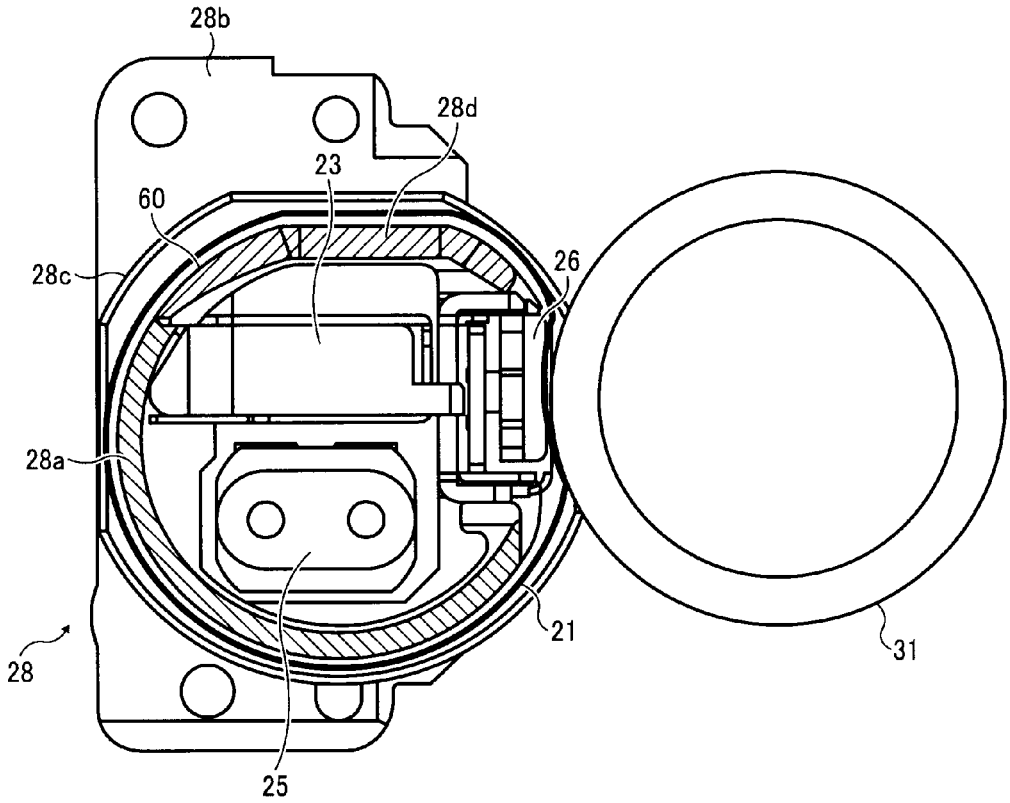
FIG. 17 is a front view illustrating the holding member is fitted in the flange member.

As mentioned above, in the fixing device 20 of the present invention, the cylinder 28*a* of the flange member 28, having a predetermined shape of the outer circumferential surface, holds proper shapes of vicinities of both ends of the fixing belt 21 in its axial direction through the support member 60 as FIG. 17, and can improve separability of a recording medium, particularly of a wide recording medium. The flange 28 does not impair preciseness of the cross-sectional shape of the support member 60, and can stabilize the shape of the support member 60 and movement thereof when driven.

The flange member 28 is inserted into both ends of the support member 60 in its axial direction to stabilize the cross-sectional shapes thereof although it does not stabilize its central shape. However, the following three effects can be expected even when only the shapes of the ends are stabilized.

(Effect 1) Improvement of Separability of a Wide Recording Medium P Passing Near Both Ends in the Axial Direction.

When the maximum outer diameter 18 (30.86 mm) of the support member 60 becomes less beyond a specific range, the fixing belt 21 is not tightly wound and becomes loose at a downstream side of the nip and has a larger curvature, resulting in less separability of a recording medium P. Therefore, the desired shape of the support member 60 is preferably maintained. At both ends of a recording medium P in its width direction, areas toner does not adhere to as non image forming areas and easy to separate from the fixing belt 21 are present. The flange member 28 maintains the desired shapes near the both ends of the support member 60 in its axial direction to make the both ends of a recording medium P in its width direction easier to separate for improving separability. This is more effective for a wide recording medium P passing its ends in its width direction near the both ends of the support member 60 in its axial direction.

(Effect 2) Regulation of the Support Member 60 Movement when the Fixing Belt is Driven The fixing belt 21 is driven by the pressure roller 31 at the nip 27, and is tight at an upstream side from the nip 27 and loose at a downstream side therefrom. The support member 60 is constantly pressurized by the frictionally moving fixing belt 21 at its tight side, and is unstable in its shape and position.

In the present invention, the shape and position of the support member 60 at the tight sight of the fixing belt (upstream side from the nip) can be stabilized by the flange member 28.

(Effect 3) Float Regulation of the Fixing Belt 21 at the End of the Support Member 60 in its Axial Direction The fixing belt 21 is likely to float at the both ends more than the center in the axial direction. This is because it takes a certain level of time until the whole support member 60 has a uniform temperature since the support member 60 is formed of a thin metallic plate. Namely, the support member 60 has a heat expansion difference in its axial direction until the whole support member 60 has a uniform temperature. The support member 60 is positionally regulated at the end in its axial direction by the flange member 28, and the center thereof most largely expands outside and warps. The warp is made at the center of the support member 60 in its axial direction at a side of the heated area 63, which most largely expands and closely contacts the fixing belt 21. Meanwhile, the end of the support member 60 in its axial direction, which is regulated by the flange member 28 does not have a warp, and the fixing belt 21 pushed by the support member 60 expanding its center is likely to float at the end.

In the present invention, the shape of the end of the support member 60 in its axial direction is held and stabilized by the flange member 28 to prevent the fixing belt 21 from floating.

Figure 18:
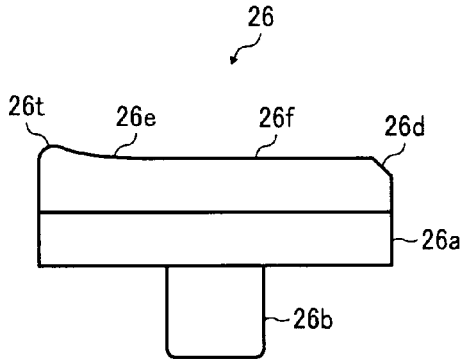
FIG. 18 is a cross-sectional view illustrating a detailed configuration of the nip forming member of the first embodiment of the fixing device of the present invention.

In the fixing device 20 of the present invention, the nip forming member 26 includes a flat surface 26*f*, an and a projection 26*t* from an upstream side in a recording medium P feeding direction at a surface of the pressure roller 31 side as FIG. 18 shows.

The flat surface 26*f* is formed at an upstream side of the nip 27, and a recording medium P bearing toner image is fed to the nip 27 without flexure.

In the present invention, the flat surface 26*f* has a chamfered part 26*d* of 0.5 mm at its upstream end. This prevents the fixing belt from deteriorating in its durability due to a large flexure at the upstream end of the flat surface 26*f* when an inner surface of the fixing belt 21 having rotated and frictionally contacted the support member 60 starts frictionally contacting the upstream end of the nip forming member 26.

When the chamfered part 26*d* is not formed at the upstream end of the flat surface 26*f*, the fixing belt 21 possibly rotates with a gap between the fixing belt 21 and the support member 60 near the downstream end of thereof because there is a microscopic difference in level between an outer circumferential surface at the downstream end of the support member 60 and a surface at the upstream end of the nip forming member 26. Therefore, the fixing belt 21 is not fully heated and rotates at the nip 27, resulting in deterioration of heating efficiency.

When the chamfered part 26*d* is formed at the upstream end of the flat surface 26*f*, the fixing belt 21 frictionally contacts a vicinity of the downstream end of the support member 60 (introduction area 62) located at an upstream side of the nip forming member 26, and the nip 27 can efficiently be heated.

Figure 19:
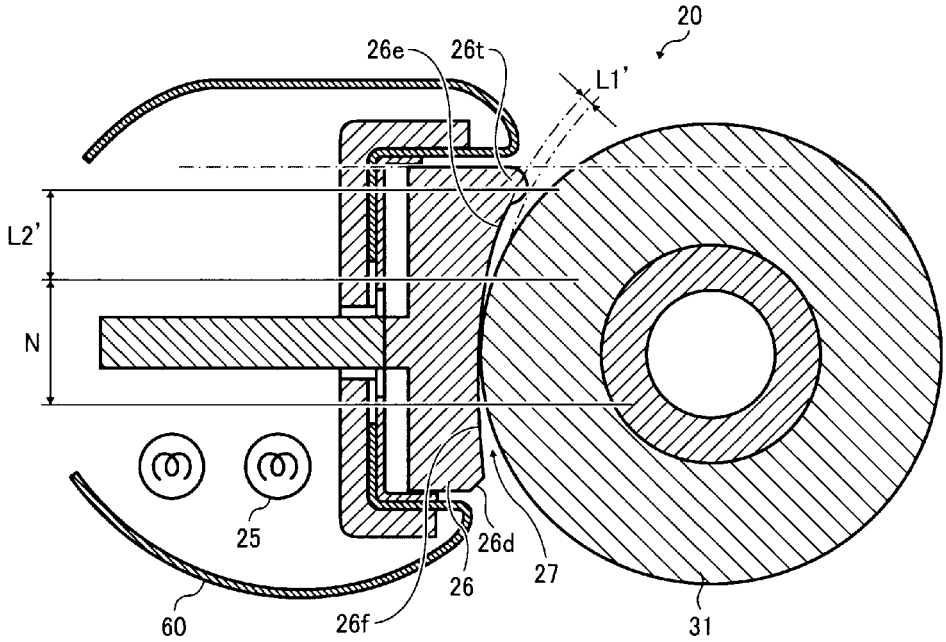
FIG. 19 is an explanation drawing for setting the shape of the nip forming member in FIG. 18.

Next, the shapes of the projection 26*t*, the arc-shaped part 26*e* and the flat surface 26*f* are explained in more detail, referring to FIGS. 18 and 19.

The projection 26*t* has a peak at a position separate from the downstream end of the nip 27 having a width N by a predetermined length of L2' at the downstream side of the nip 27 in a recording medium feeding direction. The peak of the projection is located on an arc having the same center as that of the arc-shaped part 26*e* and a radius shorter than that thereof by L1'.

L1' and L2' are determined as follows.

First, if L2' is shorter than 1 mm, the projection 26*t* contacts the pressure roller 31. When the projection 26*t* contacts the pressure roller 31, a part where the nip forming member 26 (specifically the arc-shaped part 26*e*) and the pressure roller 31 do not contact each other is made at an upstream side of the projection 26*t* in a recording medium feeding direction. This part has a nip pressure lower than that of a part where the nip forming member 26 and the pressure roller 31 contact each other. Therefore, a contact pressure between the fixing belt 21 and toner image T on a recording medium P is low, resulting in possible abnormal toner images fixed on thereon such as rough images.

If L2' is larger than 2 mm and L1' is larger than 0.2 mm, a recording medium having passed the nip 27 is bent by the projection 26*t* toward the pressure roller 31 and possibly wound therearound. Particularly in both side printing, when toner image T is fixed on a side of a recording medium P, the toner image T is heated and has higher viscosity when the recording medium P is fed to the nip 27 again to fix toner image T' on the other side. The toner image T having higher viscosity is fixed on the recording medium P facing the pressure roller 31, separability between a recording medium P and the pressure roller 31 deteriorates, resulting in higher possibility that a recording medium P is wound around the pressure roller 31.

If L1' is smaller than 0.1 mm, the projection 26*t* cannot fully separate a recording medium P from the fixing belt 21, resulting in higher possibility that a recording medium P is wound around the fixing belt 21.

Therefore, the projection 26*t* preferably has L1' of from 0.1 to 0.2 mm and L2' of from 1 to 2 mm.

The arc-shaped part 26*e* is extensively present from any positions in the nip 27 for L2', and has the shape of an arc having a curvature radius R of from 25 to 60 mm along an outer circumferential surface of the pressure roller 31. In the present invention, the curvature radius R is 60 mm.

In the present invention, an upstream end of the arc-shaped part 26*e* is located at a downstream side of the center (center line 26*c*) of the nip 27 in a recording medium feeding direction. Namely, in the nip 27, a nip width formed by the flat surface 26*f* and the pressure roller 31 is larger than that formed by the arc-shaped part 26*e* and the pressure roller 31. However, the upstream end of the arc-shaped part 26*e* may be located at the center of the nip 27 or at an upstream side thereof.

The projection 26*t* is formed of an arc having a predetermined curvature radius contacting both of an arc of L1' and a line passing a downstream end of the arc-shaped part 26*e*, and which is perpendicular to a recording medium feeding direction.

In the fixing device 20, separability improvement effects of the cylinder 28*a* of the flange member 28 and the shape of the projection 26*t* of the nip forming member 26 can reliably separate a recording medium P having passed the nip 27 from the fixing belt 21.

Second Embodiment

Next, the second embodiment of the fixing device of the present invention is explained.

Figure 20:
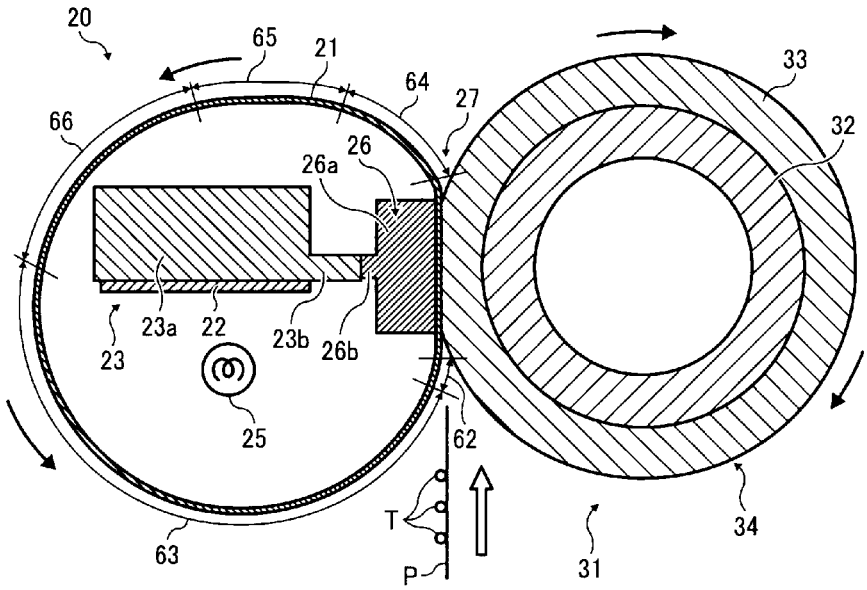
FIG. 20 is a central longitudinal sectional view illustrating a second embodiment of the fixing device of the present invention.
Figure 21:
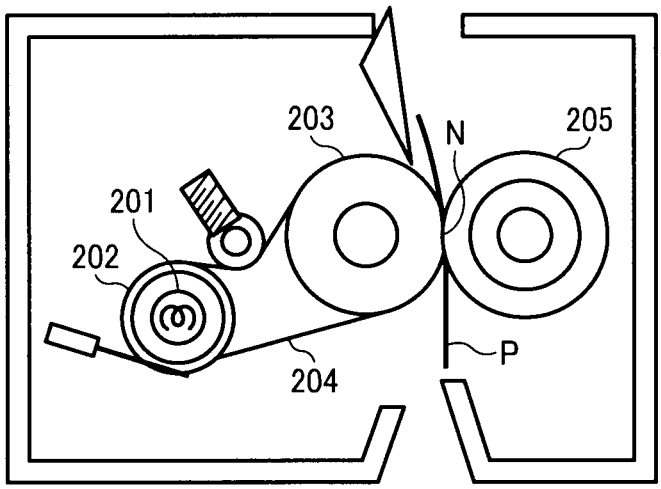
FIG. 21 is a schematic view illustrating a fixing device using a conventional belt fixing method.
Figure 22:
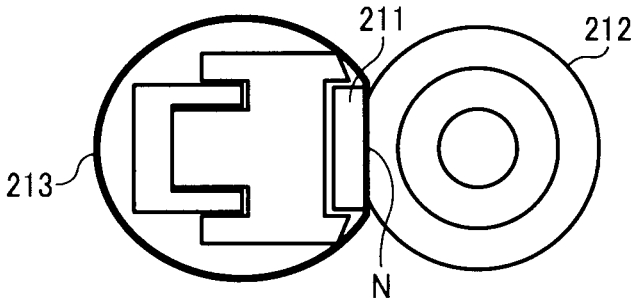
FIG. 22 is a schematic view illustrating a fixing device using a conventional film heating method.

FIG. 20 is a sectional view illustrating a second embodiment of the fixing device of the present invention.

As FIG. 20 shows, compared with the first embodiment (FIG. 2), this embodiment differs in directly inserting the cylinder 28*a* of the flange member 28 into bores at both ends of the fixing belt 21 in its axial direction to support vicinities thereof without using the support member 60, and equals to the first embodiment in the others. The fixing belt 21 is directly heated by the heater 25 located in the bore.

The cylinder 28*a* of the flange member 28 directly supports the vicinities of both ends of the fixing belt 21 in its axial direction not through the support member 60 to hold a proper shape of at least the vicinities of both ends of the fixing belt 21 in its axial direction as it does in the first embodiment.

At least an area corresponding to an area of the fixing belt 21 heated by the heater 25 preferably has nearly the same shape of a cylindrical inner circumferential part at the heated area 63 of the support member 60 in the first embodiment, and the outer circumferential shape (cross-sectional shape of the outer circumferential surface) of the cylinder 28*a* preferably has nearly the same shape and size of the inner circumferential side of the support member 60 to hold the desired shape and size of the fixing belt 21 (FIG. 5).

Namely, as a cross-sectional shape of the outer circumferential surface of the cylinder 28*a* of the flange member 28, an area corresponding to an area of the fixing belt 21 heated by the heater 25 (area A and a corresponding heated area 63') has the shape of an arc having a predetermined radius corresponding to a radius of the fixing belt 21 (in this embodiment, the shape of an arch having nearly the same radius as that of the inner circumferential side of the fixing belt 21) and the arc has a center located at an upstream side of a central line 26*c* of the nip forming member 26 in a recording medium feeding direction.

In addition, as the cross-sectional shape of the outer circumferential surface of the cylinder 28*a* of the flange member 28, a nip entrance area (the corresponding heated area 63') preferably projects to an outer direction of the cylinder diameter more than a nip exit area (the corresponding separation area 64') relative to the center line 26*c* of the nip forming member 26 in the recording medium feeding direction.

Further, as the cross-sectional shape of an outer circumferential surface of the cylinder 28*a* of the flange member 28, a corresponding flat escape area 65' is preferably located at a downstream side in a rotational direction of the fixing belt 21 relative to the nip exit area (the corresponding separation area 64').

Therefore, the cylinder 28*a* of the flange member 28 in this embodiment preferably has the shape in FIG. 14 and the following sizes.

Radius R1: 14.5 mm
Radius R2: 13 mm
Distance d1: 3.4 mm
Distance d2: 2.7 mm Distance d3: 2 mm Distance d4: 11.5 mm Outer diameter $D_{18}'$: 30.86 mm As mentioned above, in the fixing device 20 of the present invention, the cylinder 28*a* of the flange member 28, having a predetermined shape of the outer circumferential surface, directly holds proper shapes of vicinities of both ends of the fixing belt 21 in its axial direction, and can improve separability of a recording medium, particularly of a wide recording medium.

This embodiment does not use the support member 60, and only the effect 1 out of the 3 effects of first embodiment can be obtained therein.

The fixing device 20 of this embodiment exerts the effect of the present invention even for A3 size recording medium P, and exerts the effect more for A4 size recording medium P because the flange member 28 exerts an effect of holding the shape of the fixing belt 21 to the center thereof in its axial direction.

Additional modifications and variations of the present invention are possible in light of the above teachings. It is therefore to be understood that within the scope of the appended claims the invention may be practiced other than as specifically described herein.

What is claimed is:

1. A fixing device, comprising:

a rotatable endless belt fixing member;

a pressure member located at an outer circumferential side of the fixing member, configured to press against the fixing member;

a nip forming member located at an inner circumferential side of the fixing member, configured to contact the pressure member through the fixing member to form a nip;

a reinforcing member fixed at a bore of the fixing member, configured to support the nip forming member from the opposite side of the nip;

a heating member configured to directly or indirectly heat a predetermined area of the fixing member at an upstream side of the nip;

a flange member comprising a cylinder inserted in an inner circumference of the fixing member at an edge of the fixing member in an axial direction thereof and configured to rotatably hold an edge vicinity of the fixing member directly or indirectly with the outer circumferential surface of the cylinder, and a flange fixed on a frame of the fixing device, wherein the cylinder of the flange member comprises a notch in the circumference configured to contain the nip forming member, and further comprises an arc-shaped outer circumferential cross-section at an area corresponding to an area where the fixing member is heated by the heating member, having a predetermined radius equivalent to a radius of the fixing member, and the arc-shaped outer circumferential cross-section has a center located at an upstream side in a recording medium feeding direction relative to a center line of the nip forming member in the recording medium feeding direction, and wherein the fixing member is not supported beyond at least the upstream side of the nip in the direction of rotation of the fixing member, except by the flange member at the axial edge vicinity of the fixing member.

2. The fixing device of claim 1, wherein an entrance area of the nip projects farther beyond the circumference of the cylinder of the flange member than an exit area of the nip relative to a center line of the nip forming member in the recording medium feeding direction.

3. A fixing device, comprising:

a rotatable endless belt fixing member;

a pressure member located at an outer circumferential side of the fixing member, configured to press against the fixing member;

a nip forming member located at an inner circumferential side of the fixing member, configured to contact the pressure member through the fixing member to form a nip;

a reinforcing member fixed at a bore of the fixing member, configured to support the nip forming member from the opposite side of the nip;

a heating member configured to directly or indirectly heat a predetermined area of the fixing member at an upstream side of the nip;

a flange member comprising a cylinder inserted in an inner circumference of the fixing member at an edge of the fixing member in an axial direction thereof and configured to rotatably hold an edge vicinity of the fixing member directly or indirectly with the outer circumferential surface of the cylinder, and a flange fixed on a frame of the fixing device, wherein the cylinder of the flange member comprises a notch in the circumference configured to contain the nip forming member, and further comprises an arc-shaped outer circumferential cross-section at an area corresponding to an area where the fixing member is heated by the heating member, having a predetermined radius equivalent to a radius of the fixing member, and the arc-shaped outer circumferential cross-section has a center located at an upstream side in a recording medium feeding direction relative to a center line of the nip forming member in the recording medium feeding direction, further comprising a corresponding flat escape area located at a downstream side in a rotational direction of the fixing member relative to the exit area of the nip.

4. The fixing device of claim 1, further comprising a substantially cylindrical support member heated by the heating member at an inner circumferential side of the fixing member and frictionally contacting its outer circumferential surface to an inner circumferential surface of the fixing member to heat the fixing member to support the rotation of the fixing member, wherein the flange member inserts the cylinder into an inner circumference of the support member at the edge thereof in its axial direction to maintain a shape of the fixing member near the edge thereof in its axial direction with the outer circumferential surface of the cylinder of the flange member.

5. The fixing device of claim 4, wherein the support member comprises:

a heated area located at an upstream side of the nip in a rotational direction of the fixing member and heated by the heating member;

a separation area located at a downstream side of the nip in the rotational direction of the fixing member where a recording medium is separated from the fixing member; and an intermediate area continuously located at a downstream side of the separation area in the rotational direction of the fixing member and continuously located next to the heated area, wherein:

the heated area has a cross-section having the shape of an arc having substantially the same radius as that of the fixing member and a center of the arc is located at an upstream side of the nip forming member in a recording medium feeding direction relative to a central line of the recording medium feeding direction;

the separation area has a cross-section having the shape of an arc, a center of the arc located at a downstream side of the recording medium feeding direction and a side of the nip relative to the center of the arc of the heated area;

a maximum outer diameter between the heated area and the separation area is a maximum outer diameter of the support member and larger than an inner diameter of the fixing member; and at least an area corresponding to an area of the fixing member heated by the heating member has substantially the same shape of a cylindrical inner circumferential part at the heated area of the support member as a cross-section of an outer circumferential surface of the cylinder of the flange member.

6. An image forming apparatus, comprising the fixing device according to claim 1.

* * * * *